US005532809A

United States Patent [19]

Hamanaka et al.

[11] Patent Number: 5,532,809

[45] Date of Patent: Jul. 2, 1996

[54] COPYING MACHINE HAVING AUTOMATIC DOCUMENT FEEDING DEVICE

[75] Inventors: Izumi Hamanaka; Mitsuru Nagoshi, both of Hachioji; Toshio Yokoyama, Kiyose; Toshitaka Matsumoto, Asaka; Hiroshi Gomi, Urawa; Masaru Goto, Tokyo; Masaaki Sekiguchi, Asaka, all of Japan

[73] Assignee: Konica Corporation, Tokyo, Japan

[21] Appl. No.: 206,539

[22] Filed: Mar. 4, 1994

[30] Foreign Application Priority Data

| | | | |
|---|---|---|---|
| Mar. 8, 1993 | [JP] | Japan | 5-046757 |
| Mar. 8, 1993 | [JP] | Japan | 5-046758 |
| Mar. 11, 1993 | [JP] | Japan | 5-050824 |

[51] Int. Cl.[6] ..... G03G 21/00

[52] U.S. Cl. ..... 355/308; 271/3.15; 355/309; 355/316

[58] Field of Search ..... 355/230, 308, 355/309, 317, 316, 318, 319, 320, 75, 72; 271/3.08, 3.15, 301, 176, 182, 272, 273, 274

[56] References Cited

U.S. PATENT DOCUMENTS

| | | | |
|---|---|---|---|
| 4,420,149 | 12/1983 | Schultes et al. | 355/318 X |
| 4,561,765 | 12/1985 | Masuda | 355/320 X |
| 4,629,311 | 12/1986 | Kaneko et al. | 355/319 |
| 5,052,671 | 10/1991 | Matsuo | 355/309 |
| 5,120,039 | 6/1992 | Yamada | 355/308 X |
| 5,317,372 | 5/1994 | Nakabayashi et al. | 355/308 X |
| 5,333,043 | 7/1994 | Yamada | 355/309 |
| 5,343,281 | 8/1994 | Yamada | 355/320 |

FOREIGN PATENT DOCUMENTS

| | | |
|---|---|---|
| 61-178363 | 8/1986 | Japan . |
| 62-12564 | 1/1987 | Japan . |
| 62-70159 | 3/1987 | Japan . |
| 62-111854 | 5/1987 | Japan . |
| 3-152053 | 6/1991 | Japan . |

*Primary Examiner*—Arthur T. Grimley
*Assistant Examiner*—Shuk Y. Lee
*Attorney, Agent, or Firm*—Frishauf, Holtz, Goodman, Langer & Chick

[57] ABSTRACT

A copying machine equipped with an automatic document feeding device has a document stacker on which a plurality of documents can be stacked, a feeding section in which a sheet of document is separated from plural documents stacked on the document stacker and is fed to an image reading section, a conveyance section in which the document fed to the image reading section is conveyed and is stopped at a predetermined image reading position and then the document, after being read, is conveyed, and a sheet-ejecting section which is located at the downstream side in the conveyance direction from the image feeding section and ejects the document fed out of the conveyance section to a delivery tray. A document trailing edge detector is provided on the document stacker, a pass of the trailing edge of the last document on the document stacker is detected, and detection signals therefrom are sent to a main body of the copying machine to control a sheet feeding of the sheet feeding section of the copying machine.

4 Claims, 16 Drawing Sheets

1 SHEET OF DOUBLE-SIDED COPY
COPY BUTTON ON

COPYING MACHINE HAVING AUTOMATIC DOCUMENT FEEDING DEVICE

BACKGROUND OF THE INVENTION

The present invention relates to an automatic document feeding device provided on a recording apparatus such as an electrophotographic copying machine and on an image reading apparatus, and more particularly to a document stacker where single-sided or double-sided image documents are stacked.

As a device capable of feeding a document on which images are recorded efficiently even under the unmanned condition in an electrophotographic copying machine or in a recording apparatus such as a recorded image reading apparatus, there has already been provided an automatic document feeder (ADF).

In recent copying machines, in particular, high copying process speed, high document conveyance speed of ADF, and shortened time for document change and for recording sheet feeding for an improvement of copy productivity have been attained for the purpose of elevating copying efficiency.

In a copying machine equipped with a conventional automatic document feeding device, time for feeding a recording sheet is shortened in a manner wherein passage of the trailing edge of a document is detected by a document trailing edge detecting means provided at the feeding section in the main body of the automatic document feeding device, and detection signals therefrom are sent to the main body of the copying machine, and thereby the following recording sheet is fed preliminarily from a sheet feeding device in the copying machine.

The preliminary sheet feeding mentioned above is especially effective because of a long sheet feeding path when a copying machine is of structure wherein a sheet-feeding cassette containing recording sheets and a stacker for double-sided copying are positioned to be far from a transfer unit in an image forming section.

However, when the last document is fed and detection signals for passage of the trailing edge of the last document (no following document) are sent, a sheet feeding device in the main body of the copying machine receives the signals and operates to start preliminary feeding for a following recording sheet despite no following document existing. Therefore, it is necessary to return the recording sheet fed preliminarily.

The invention further relates, in particular, to an improvement of a sheet feeding section wherein documents stacked on a document stacker are fed out by a feed-out means, one sheet of document is separated from the documents by a separating means to be fed, the separated document is aligned by a pair of registering rollers for standby thereof and then is fed to an image reading section.

Further, a reversible automatic document feeder (R-ADF) that is represented by the aforementioned ADF equipped with a function of turning over a document has been put to practical use for a copying machine capable of copying each image on a document (double-sided document) having recorded images on its both sides on one side or on both sides of a recording material or for an image reading apparatus capable of reading and recording the images mentioned above.

Document conveyance on a document placing glass (a platen glass) in the reversible automatic document feeder (R-ADF) mentioned above is carried out by a conveyance belt which is wound around a conveyance driving roller and a conveyance driven roller to be capable of running regularly and reversely.

As a means of stopping conveyance for positioning a document conveyed by the above-mentioned conveyance belt at the predetermined location on a platen glass, there are available a method wherein a document is caused to hit a stopper to be positioned and a method wherein a sensor detects an edge of a document pass and a timer or a counter is used for counting time to control the position of the document.

As a method for stopping a document by means of a conveyance belt in the document feeder mentioned above, there has generally been used a method wherein an edge of a document hits a stopper plate affixed at an end of a platen glass. The method, however, has a problem that it takes time before a document is stopped, an accuracy of a stopped position for a document is unstable, and an edge of a document is damaged.

For solving the problem mentioned above, there is available a method wherein a document is controlled to stop without hitting a stopper plate during automatic conveyance of the document. In this method, however, a stopping position of a document varies exceedingly, which has not been solved yet.

Further, the invention relates to an automatic document feeding device having a single-sided image document conveyance (ADF) mode wherein a sheet of single-sided or double-sided image document is separated from those stacked on a document stacker and is fed to an image reading section, and then it is ejected, after being read, onto a delivery tray, or a double-sided image document reversing/conveying (R-ADF) mode wherein a document whose image has been read is turned over and is conveyed again to an image reading section.

In a recent copying machine wherein a copying speed has been increased for enhancing copying efficiency and thereby a document conveyance speed has also been increased (approx. 1000–1200 mm/sec) so that a document is ejected onto a delivery tray at that speed, in particular, documents are ejected onto the delivery tray irregularly or they jump out of the delivery tray.

Various suggestions have been made as a measure for the problem mentioned above. For example, what is disclosed in Japanese Patent Publication Open to Public Inspection No.61-178363(hereinafter referred to as Japanese Patent O.P.I. Publication) (conventional example 1) is characterized to have a sheet-ejecting roller decelerating means wherein a sheet sensor that detects a pass of a document is provided immediately before a sheet-ejecting roller, and rotating speed of the sheet-ejecting roller is decreased when the trailing edge of a document is detected by the sheet sensor.

Further, what is disclosed in Japanese Patent O.P.I. Publication No. 62-12564conventional example 2) is equipped with a switching means capable of changing rotating speed of a document-ejecting means to the first ejecting speed that is the same as the document conveyance speed or to the second ejecting speed that is lower than the first ejecting speed.

On the other hand, in Japanese Patent O.P.I. Publication No.62-70159(conventional example 3), it is disclosed that ejection speed is reduced by a brake and a clutch when the trailing edge of a document to be ejected is detected by a sensor.

In Japanese Patent O.P.I. Publication No. 62-111854(conventional example 4), it is disclosed that conveyance speed is kept to be slower for a certain period of time after the trailing edge of a document is detected.

Furthermore, in Japanese Patent O.P.I. Publication No. 03-152055(conventional example 5), there are disclosed a low speed ejecting roller and a pressing member capable of being brought into pressure-contact with or released from the low speed ejecting roller.

Further, a problem of skewed copy caused by a document skewed in the course of conveyance thereof and a problem that an ejected document falls out of an apparatus due to down-sizing are remain unsolved.

The proposals mentioned above have various features and are effective as a measure. However, they are not necessarily free of problems. For example, in the conventional examples 1 and 4, when a conveyance belt and a sheet-ejecting roller are driven by a single motor, lowered speed of the motor causes also a conveyance belt to be slow in speed, making it difficult for the following document to be conveyed onto a platen glass, thus copying productivity can not be enhanced. When an additional motor is used unlike the conventional example 1 employing only one motor, it is not advantageous in terms of cost. In the conventional example 2, gear train for driving is complicated and it requires a large number of gears, resulting in a high cost.

In the conventional example 3, a combination of a brake and a clutch is complicated and it requires many parts, resulting in high cost. Further, durability of a clutch is also doubtful.

In the conventional example 4, a means for controlling document conveyance speed is complicated and expensive, which is a disadvantage.

In the conventional example 5, a pressing member and a claw for switching between sheet-reversing and sheet-ejecting require respectively different driving sources (solenoid or the like), causing problems of timing control and high cost.

As stated above, it is necessary to reduce a sheet-ejecting speed for the purpose of preventing that documents are ejected irregularly onto a delivery tray. It is confirmed experimentally that a linear speed at which the documents can be ejected regularly onto a delivery tray positioned almost horizontally is not more than 400 mm/sec. However, when a total automatic document feeder is driven at a document conveyance speed of not more than 400 mm/sec, a ratio of Opm (number of fed documents per minute in ADF) to Cpm (number of copies per minute in a copying machine) is reduced. When Cpm on the main body side of a copying machine is raised to be high speed (for example, 50–70 sheets per minute for A4 size), it is desired to attain copying productivity of 100% by achieving the high number of documents conveyed matching with the Cpm. For the purpose of enhancing further the aforesaid linear speed and still attaining regular sheet alignment, a delivery tray has been inclined so that a document ejected out of an apparatus may climb along the inclined delivery tray to be reduced in its speed. In this case, the total height of ADF is increased, and when the ADF is structured to be opened toward an operator, a wall side located on the back side of a copying machine hits articles. For avoiding this, therefore, an excessive space needs to be provided on the rear side of the copying machine, resulting in problem of an increase of a floor space.

When a document of the maximum size (for example, A3 size or 11×17 in. size) out of documents ejected from the aforementioned ejection section is ejected, it slides on the surface of a delivery tray and jumps excessively to be scattered irregularly on the delivery tray, or it falls from the delivery tray, and sometimes, succeeding ejected documents hit preceding stacked documents due to the document of the maximum size aligned irregularly, causing defective document ejection.

Furthermore, in R-ADF wherein a double-sided image document is fed into an ejection section from a conveyance section, turned over and is conveyed again onto a platen glass, there is a fear that the document is skewed in the course of conveyance to fail to be located at the right image forming position. For this reason, a document has been pushed against a document end stopper (scale plate), which, however, caused a problem that a leading edge of a document is damaged and a document stopping means is complicated. In the case of an automatic document feeding device having no document positioning stopper on the one end on the surface of a platen glass, in particular, a defective position for document image reading caused by the skewed document mentioned above is observed remarkably.

SUMMARY OF THE INVENTION

An embodiment of a copying machine equipped with an automatic document feeding device of the invention is represented by a copying machine equipped with an automatic document feeding device comprising a document stacker on which a plurality of documents can be positioned and stacked, a feeding section wherein a sheet of document is separated from plural documents stacked on the document stacker and is fed to an image reading section, a conveyance section wherein the document fed to the image reading section mentioned above is conveyed and is stopped at a predetermined image reading position and then the document, after being read, is conveyed out, and a sheet-ejecting section which is located at the downstream side in the conveyance direction from the image reading section and ejects the document fed out of the conveyance section to a delivery tray, wherein a document trailing edge detecting means is provided on the document stacker mentioned above, thus, a pass of the trailing edge of the last document on the document stacker is detected, and the detection signals therefrom are sent to the main body of the copying machine to control the sheet feeding of the sheet feeding section of the copying machine.

In another embodiment of an copying machine equipped with an automatic document feeding device of the invention, there are provided on a document stacker a detecting means that detects existence of a document, and a signal connecting means connected by signal lines with the aforementioned detecting means provided in the vicinity of a connecting section for the automatic document feeding device in the document stacker so that the signal connecting means on the document stacker side may be connected directly with the signal connecting means provided on the main body side of the automatic document feeding device when the document stacker is mounted to the main body of the automatic document feeding device.

An object of the invention is to provide an automatic document feeding device capable of positioning a document accurately at a predetermined document reading position on a platen glass by controlling accurately the stop of a conveyance driving shaft which drives a conveyance belt.

An embodiment of an automatic document feeding device of the invention is represented by an automatic document feeding device comprising a feeding section wherein documents stacked on a document stacker are fed out by a feed-out means and a sheet of document is separated from plural documents by a separating means to be fed to an image reading section, a conveyance section wherein the document fed to the image reading section mentioned above is conveyed and is stopped at a predetermined image reading position and then the document, after being read, is conveyed out, a sheet-ejecting section which ejects the document fed out from the image reading section to a delivery tray, and a control means that controls a driving means composed of a D.C. motor driving at least the feeding section and the conveyance section mentioned above, wherein there are provided a passage sensor which is provided in the aforementioned feeding section and detects a pass of the trailing edge of a document, an electromagnetic clutch and an electromagnetic brake both provided in a power transmission route which rotates a conveyance belt of the conveyance section mentioned above, and a counter means provided on a shaft that rotates the conveyance belt or on a shaft synchronized with the aforesaid shaft.

A further object of the invention is to provide a sheet-ejecting-reversing device of an automatic document feeding device wherein documents are conveyed at high speed and ejected documents are almost aligned and stacked on a delivery tray.

A still further object of the invention is to secure an accurate image reading position by registering leading edges of documents in the aforesaid sheet-ejecting/reversing section.

Another embodiment of an automatic document feeding device of the invention is represented by an automatic document feeding device comprising a feeding section which separates one sheet of document from plural documents stacked on a document stacker and feeds it to an image reading section, a conveyance section which conveys the document fed to the image reading section, stops it at a predetermined image reading position and then conveys the document out after image reading therefor, and a sheet-ejecting/reversing section which either turns over the document conveyed out of the image reading section and conveys it to the conveyance section mentioned above or to a delivery tray located outside an apparatus, wherein a linear speed of a sheet-ejecting means located in the vicinity of an outlet of the sheet-ejecting/reversing section is set to be lower than that of a conveyance means located at the upstream side of the sheet-ejecting roller, a sheet-ejection-regulating member capable of being brought into pressure-contact with or being released from the circumferential surface of the sheet-ejecting roller and a sheet-ejecting/reversing switching means which guides the document conveyed out of the conveyance section either to an ejection path for ejecting to the delivery tray or to a reversing path where the document conveyed out is turned over and is fed again to the conveyance section are provided, and the sheet-ejection-regulating member and the sheet-ejecting/reversing switching means are interlocked in terms of operation through a single driving means.

In still another embodiment of an automatic document feeding device of the invention, a document stopper means capable of stopping a document is provided at the position where the stopper means is hit by the leading edge of a largest document among those ejected onto a delivery tray during document ejection, on the side of downstream of document ejection located on the side of the delivery tray.

In the further embodiment of an automatic document feeding device of the invention, a clutch means capable of turning on or turning off transmission of power from a driving source to a driving shaft for a sheet-ejecting/reversing roller is provided on the ejected sheet reversing section and a document edge detecting sensor is provided at the upstream side in terms of document conveyance from the nip position between the sheet-ejecting/reversing roller and a pinch roller on the sheet-ejecting/reversing section, and when reversing and conveying a document, a driving shaft for the sheet-ejecting/reversing roller is kept to be suspended for registering the leading edge of the document by turning off the clutch means until the leading edge of the document conveyed out of the conveyance section reaches the nip position, and after a predetermined period of time from the moment when the leading edge of the document passes the sensor, the sheet-ejecting/reversing roller is driven for reversing and conveying the document.

DETAILED DESCRIPTION OF THE PREFERRED EMBODIMENTS

Figure 1:
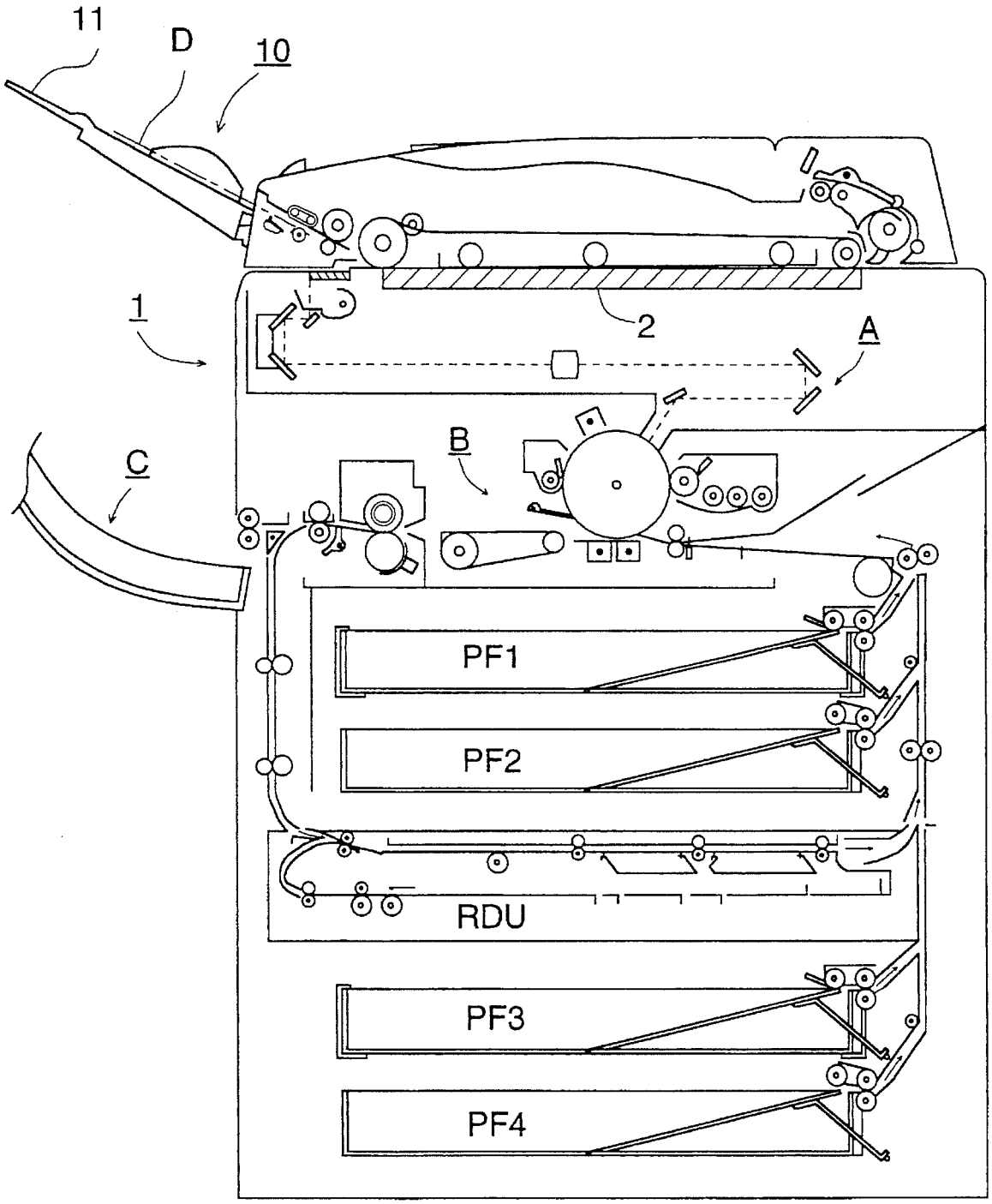
FIG. 1 is a general structural diagram of a copying machine equipped with an automatic document feeding device of the invention.

Examples of a copying machine equipped with an automatic document feeding device of the invention will be explained as follows, referring to the drawings attached hereto.

Figure 2:
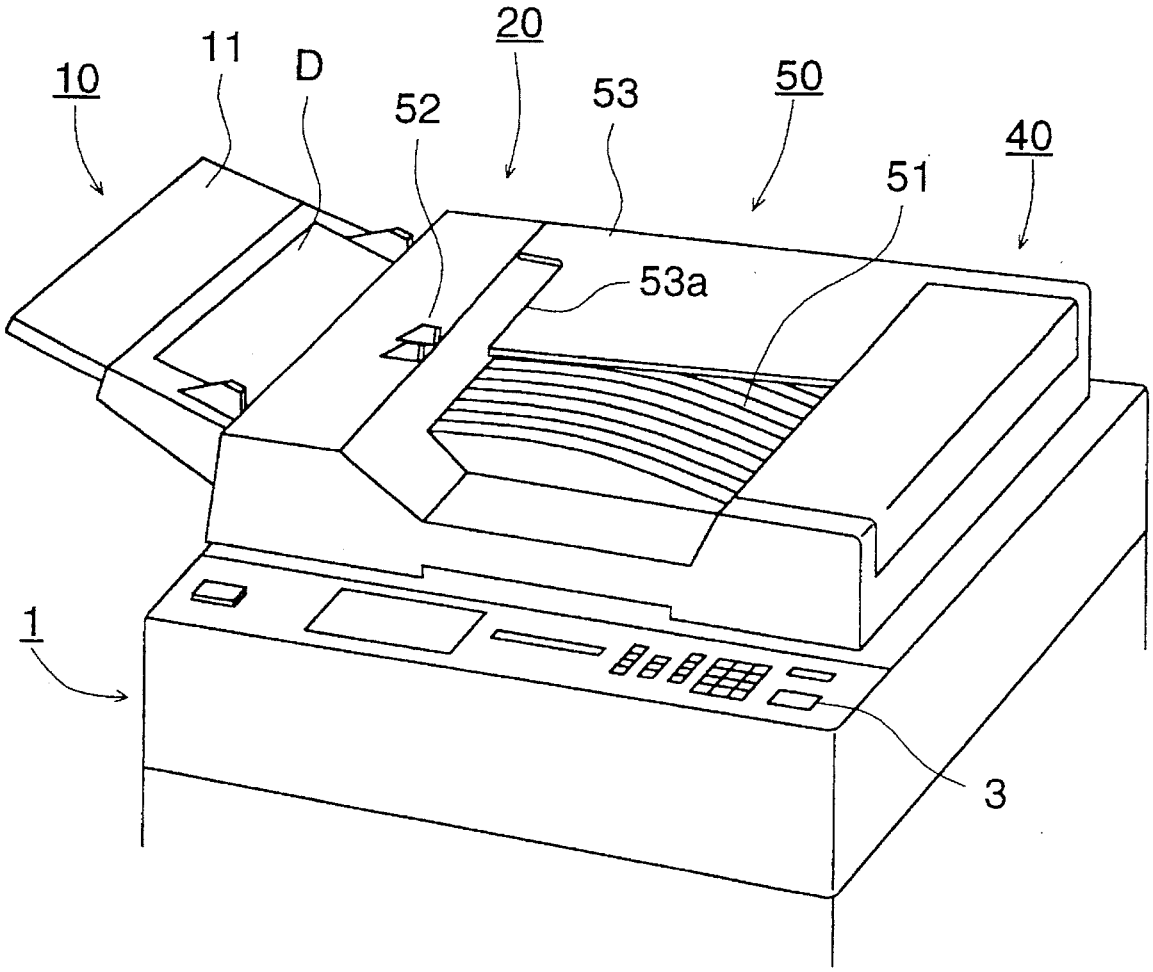
FIG. 2 is an external perspective view of the automatic document feeding device mentioned above.
Figure 3:
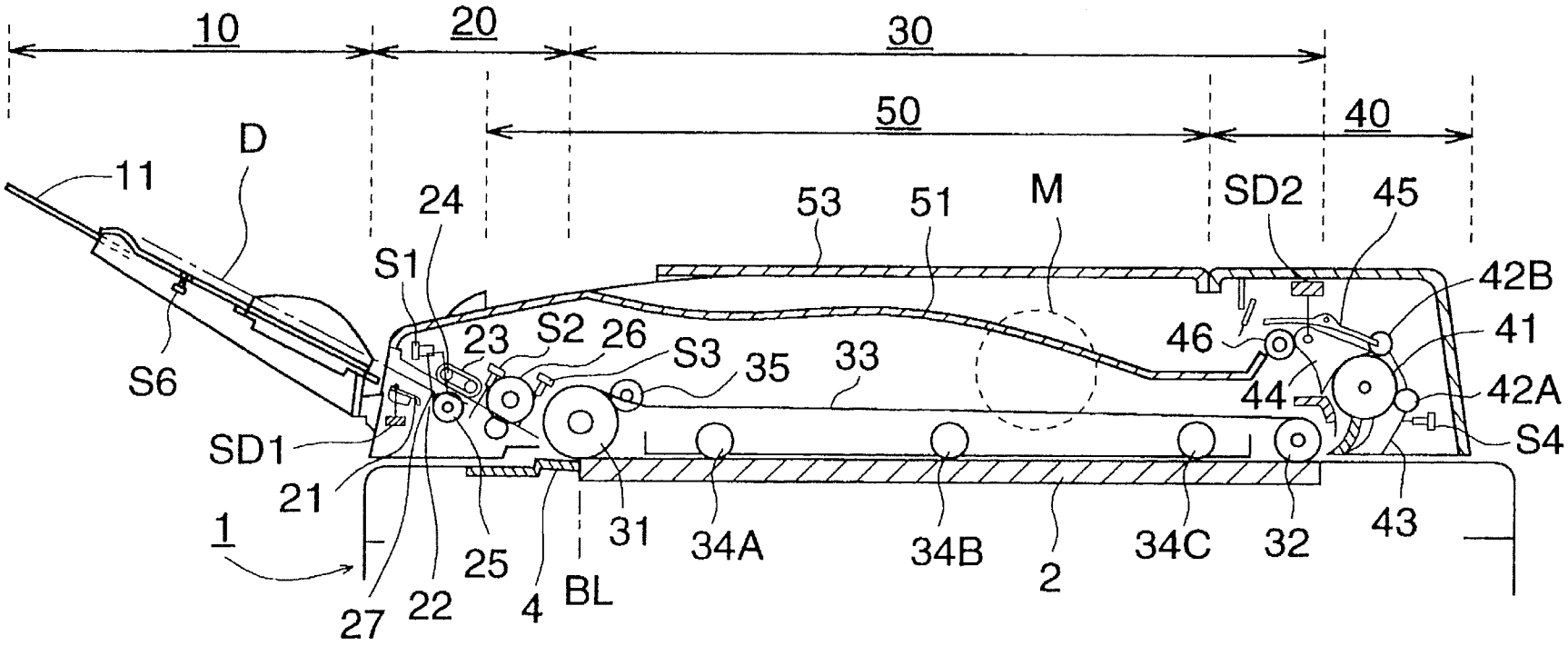
FIG. 3 is a sectional view of the automatic document feeding device mentioned above.

FIG. 1 is a general structural diagram of a copying machine equipped with an automatic document feeding device of the invention, FIG. 2 is an external perspective view of an automatic document feeding device mounted on a copying machine, and FIG. 3.is a sectional view of an automatic document feeding device. Incidentally, these devices represent an automatic document feeding device (R-ADF) equipped with an automatic document-reversing function.

The copying machine related to the invention is composed of units including document exposure scanning unit A, image forming unit B, sheet-ejecting unit C, first cassette sheet-feeding unit PF1, second cassette sheet-feeding unit PF2, double-sided copy sheet reversing/conveying unit RDU, third cassette sheet-feeding unit PF3 and fourth cassette sheet-feeding unit PF4, as shown in FIG. 1. On the top of main body 1 of the copying machine, there is mounted an automatic document feeding device (R-ADF).

The automatic document feeding device mentioned above comprises document stacker 10 on which plural documents are stacked as shown in FIG. 3, feeding section 20 that feeds out one sheet of document from a stack of documents stacked on document tray 11 of the document stacker 10 onto platen glass 2 which is an image reading section, conveyance section 30 that conveys the document fed from the feeding section 20 to a predetermined position (image exposure scanning position) on the platen glass 2 on a document stand, sheet-ejecting/reversing section 40 which ejects the document fed out from the conveyance section 30 after completion of image exposure to the outside of an apparatus, or turns over the document and returns the document again to the platen glass 2, and delivery tray 50.

First, how an automatic document feeding device of the invention is structured and how it operates will be explained as follows, referring to a sectional view in FIG. 3.

On the document tray 11 provided to be protruded from the side of main body 1 of the copying machine, there is set document D. The document D stops with its leading edge passing over movable guide plate 21 and hitting stopper member 22.

When copy button 3 (see FIG. 2) is pressed, sheet-feeding solenoid SD1 operates and thereby movable guide plate 21 jumps up to bring the document D into pressure-contact with separating belt 23. Next, due to driving of motor M, the separating belt 23 is rotated by driving roller 24 connected to a drive source, and it feeds out only one topmost sheet of document D through cooperation with reverse roller 25. When the leading edge of the document D arrives at an outlet of a nip position of intermediate conveyance rollers 26 rotating in the arrowed direction, a sheet-feeding clutch is turned off by detection signals of document size detection sensor S3, and the separating belt 23 becomes free from power transmission to run idle, thus only one sheet of document D that is preceding is conveyed by intermediate conveyance roller 26.

The document D conveyed by the intermediate conveyance roller 26 mentioned above passes over stopper plate 4 that positions the trailing edge of the document D, and is conveyed by friction force between platen glass 2 provided on the top of main body 1 of a copying apparatus and conveyance belt 33 of conveyance section 30.

The aforementioned conveyance belt 33 is wound around conveyance driving roller 31 affixed rotatably on bearing plates affixed on both side walls of a housing and conveyance driven roller 32, and is rotated by motor M regularly and reversely. A lower running surface of the conveyance belt 33 is pushed against the surface of platen glass 2 by pressure rollers 34A, 34B and 34C. The numeral 35 is a tension roller that comes into pressure-contact with the conveyance belt 33 to be driven thereby for rotation and keeps the belt tension constant.

when the size of the document D is detected automatically when its trailing edge passes document size detection sensor S3, the document D is stopped at a predetermined image reading position, being controlled by pulse count made by an encoder on a driving shaft of the intermediate conveyance roller 26. After that, copying is carried out through optical scanning conducted in main body 1 of a copying machine. After scanning for image reading, conveyance belt 33 runs regularly to feed the document D into sheet-ejecting/reversing section 40.

The document D fed into the sheet-ejecting/reversing section 40 passes through guide plate 43, sandwiched between sheet-ejecting/reversing roller 41 and a pair of pinch rollers 42A and 42B to be conveyed, passes through sheet-ejection/reversing switching means 44, sheet ejection regulating member (movable pressure plate) 45 and sheet-ejecting roller 46, and is ejected onto delivery tray 50 located outside the apparatus.

The trailing edge of the document D conveyed is detected by document ejection detecting sensor (sheet-ejection sensor) S4 located in the vicinity of the pinch roller. Then, after a period of time necessary for the trailing edge to be pinched, sheet-ejection solenoid SD2 is operated to move movable pressure member 45 so that the trailing edge may be pinched between the movable pressure member 45 and sheet-ejecting roller 47 that is located near the trailing edge of the document D and is rotating at low speed, thus, the documents D which have been ejected at high speed until that moment are subjected to slow down to be ejected onto ejected-sheet stacking surface 51 of delivery tray 50.

Figure 4:
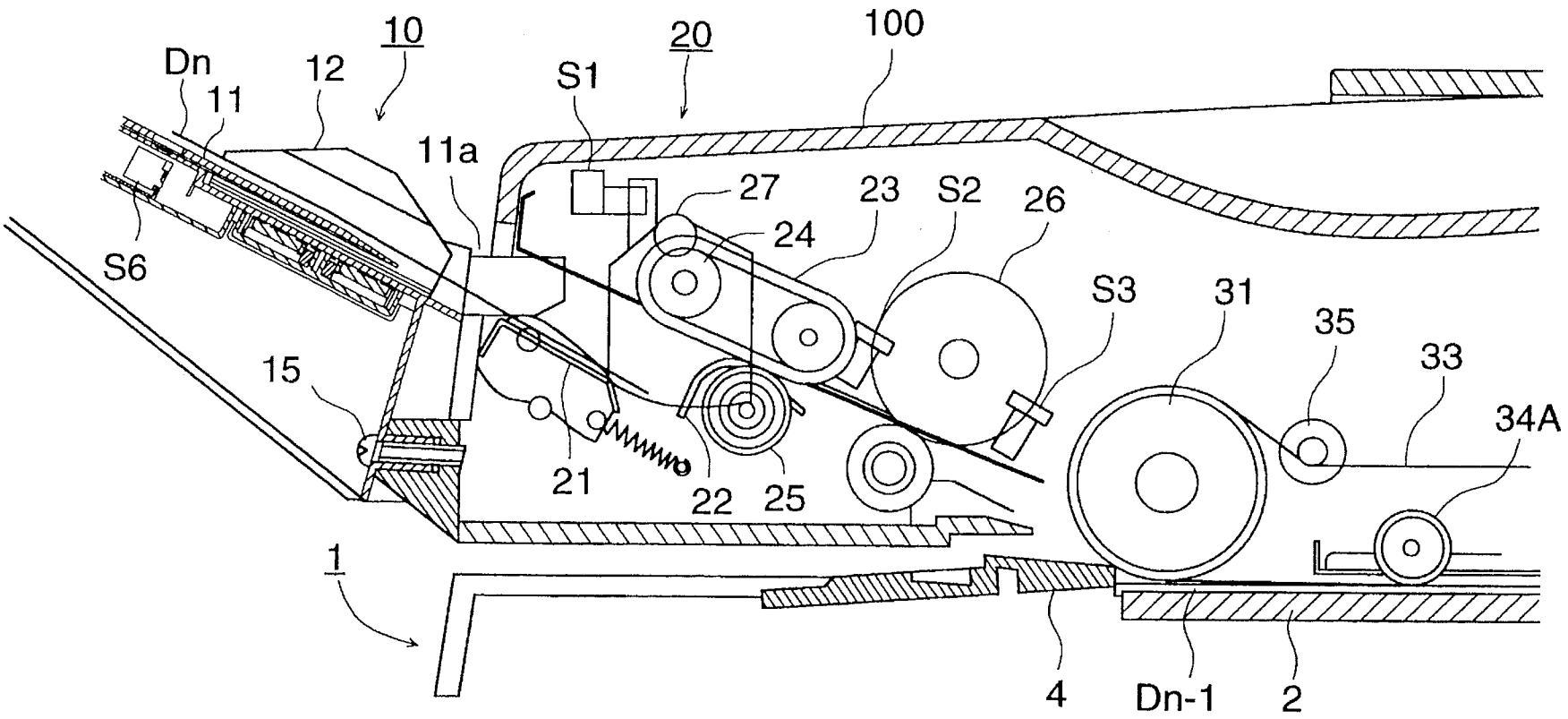
FIG. 4 is a sectional view showing how a document stacker and the main body of an automatic document feeding device are connected.
Figure 5:
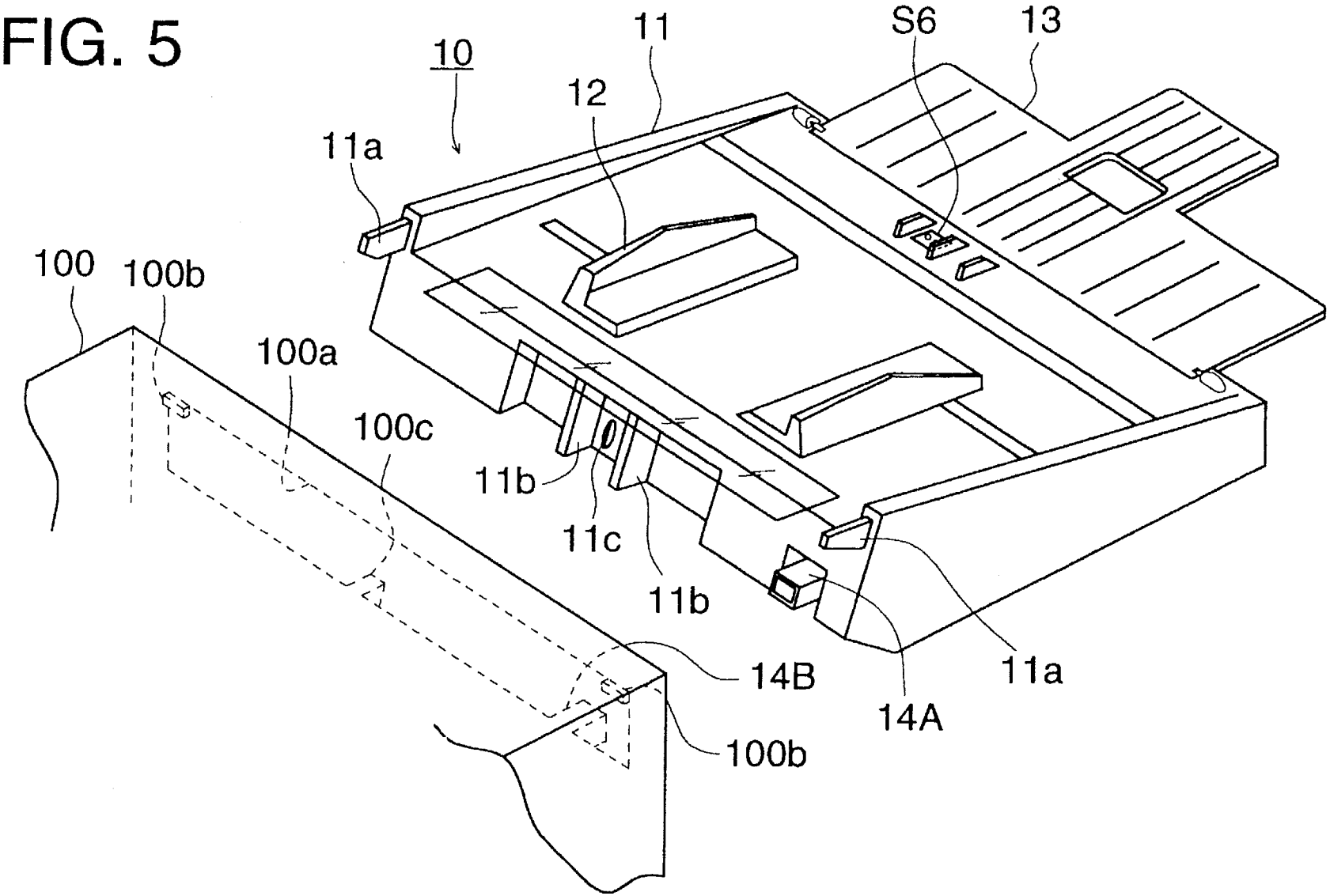
FIG. 5 is a perspective view showing how the document stacker and the main body of the automatic document feeding device mentioned above are separated.

FIG. 4 is a sectional view showing how document stacker 10 and automatic document feeding device body 100 are connected to each other, and FIG. 5 is a perspective showing how they are separated.

The document stacker 10 is composed of document tray 11, document width regulating member 12, movable tray 13, last document existence detecting sensor (hereinafter referred to as a tray sensor) S6 and connector 14A.

On both upper ends located in the vicinity of a tip face of document tray 11 (at the downstream side in terms of sheet feeding), there are protruded two tray guide protrusions 11*a*. At two locations around the center of the tip face, on the other hand, there are integrally formed protrusion rests 11*b*. At the middle portion between the protrusion rests 11*b* at two locations, there is provided tray section elongated hole 11*c*. When mounting document tray 11 at opening portion 100*a* of automatic document feeding device body 100, the vertical direction is regulated by tray guide stopper 100*b*, regulation of horizontal and upward directions is made while protrusion rest 11*b* is engaged with protrusion for guide 100*c* on automatic document feeding device main body 100 side, and then machine screw parts 15 are caused to pass through toward the protrusion for guide 100*c* from the inside of elongated hole on tray 11*c* for screwing. Thus, the document tray 11 is affixed on the automatic document feeding device main body 100 integrally.

On one end of a tip surface of the document tray 11 mentioned above, there is provided floating fit connector (receptacle) 14 A. On the other hand, floating fit connector (pin housing) 14 B is provided in the vicinity of opening 100*a* of the automatic document feeding device Mounting the document tray 11 on the automatic document feeding device main body 100 causes the connector (receptacle) 14A and connector (pin housing) 14B to be connected automatically, thus, mounting of the document tray 11 and electric connection of the connectors 14A and 14B can be completed through a single operation.

In the vicinity of the center in the lateral direction of the document tray 11 located at the upstream side in terms of the document conveyance direction, there is provided last document existence detecting sensor (tray sensor) S6. When the preliminary feeding of the last document of those stacked on the document tray 11 is started, the tray sensor S6 detects a pass of the trailing edge of the last document for controlling sheet-feeding sections PF1, PF2, PF3, PF4 and RDU of the copying machine main body 1.

In a conventional automatic document feeding device, there has been provided no tray sensor S6 on the document tray 11. In the invention, however, preliminary feeding of a recording sheet in a copying machine main body described later is controlled by the tray sensor S6. Therefore, operation for electric connection to be conducted in the course of connecting document tray 11 with automatic document feeding device main body 100 has been time-consuming. Namely, as a signal connecting means for a signal line of tray sensor S6 of document tray 11 and automatic document feeding device main body 100, a signal harness located at the automatic document feeding device side is arranged so that a certain length of the signal harness may appear, and a signal harness on the document tray 11 side also is provided inside. When mounting the document tray 11 on the automatic document feeding device main body 100, a cover and others of the document tray 11 are removed and connected with a signal harness at the automatic document feeding device side, and after the harness is housed along a tray guide, the tray cover is screwed, which, therefore, has been a problem that it is time-consuming.

Owing to floating fit connectors 14A and 14B of the invention provided on both document tray 11 and automatic document feeding device main body 100, it has become possible to carry out the aforementioned connecting operation quickly and surely through a single operation.

At the upstream side in the document feeding direction on the document tray 11, there is provided last document existence detecting sensor S6. The tray sensor S6, when the last document is subjected to preliminary feeding after the documents preceding to the last document and stacked on the document tray 11 are fed out in succession, detects the trailing edge of the last document and sends signals. Though the position for the tray sensor S6 to be affixed is set to be in the vicinity of the rear edge of an A-size which is used most frequently for copying, the position for affixing is not limited to that but is allowed to be in the vicinity of the rear edge of the smallest size. Or, a plurality of tray sensors S6 may be provided at plural positions so that they may correspond to plural document sizes (for example, in the vicinity of the rear edge of each of A-4 and B-5 sizes).

Further, two tray sensors S6 may be positioned in parallel (see FIG. 5) to detect twice for improving detecting accuracy by eliminating chattering.

In the vicinity of the above-mentioned stopper member 22 in feeding section 20 of the automatic document feeding device main body 100, there is supported in a swingable way the actuator 27 which opens or closes an optical path for document setting detecting sensor (photo-interrupter) S1. When the leading edge of a document stacked on document tray 11 hits the stopper member 22, a tip of the actuator 27 is kicked away and intercepts the optical path. Thereby, ON signals are generated from the document setting detecting sensor S1, and an ADF mode is established.

Figure 6:
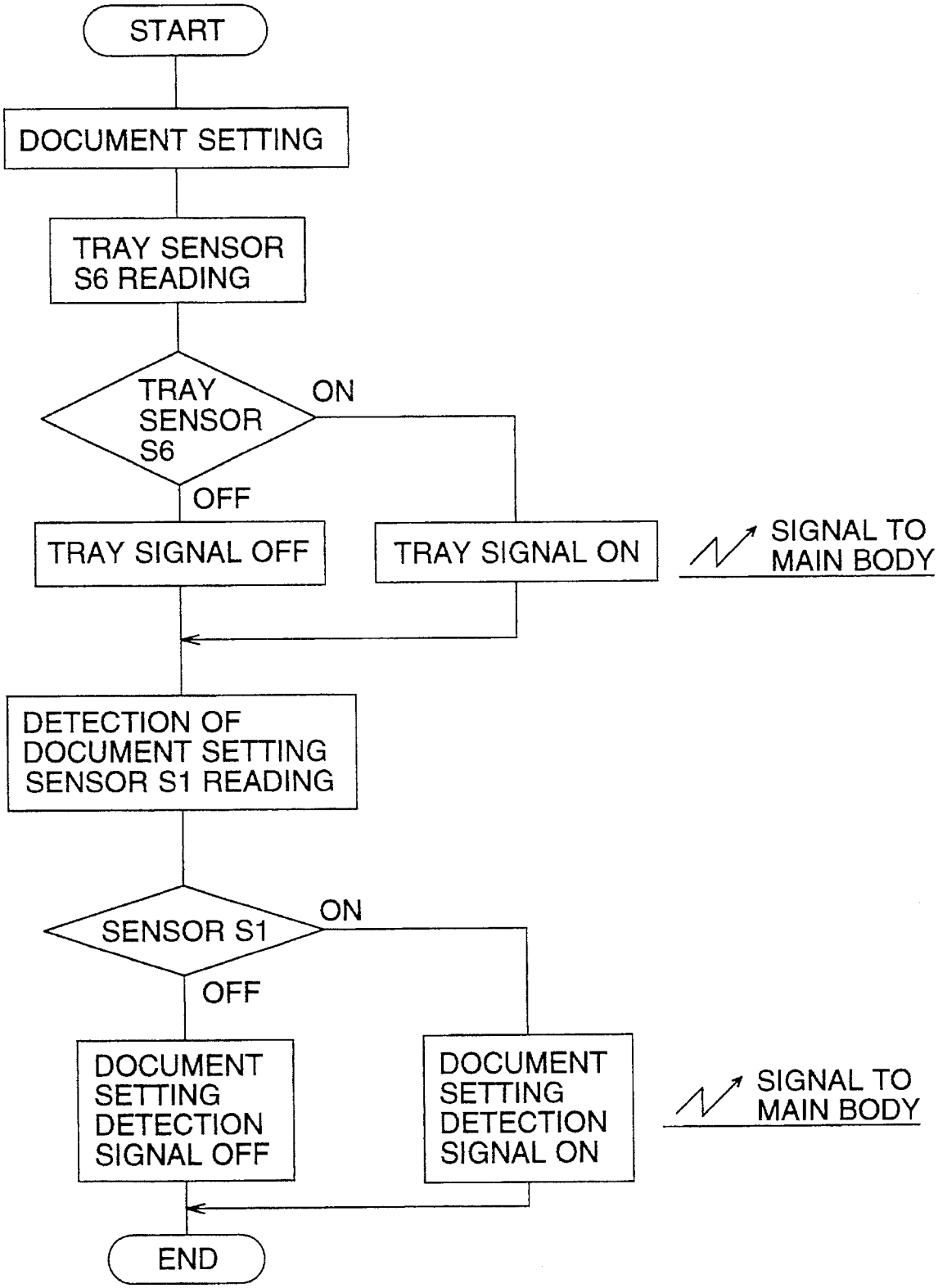
FIG. 6 is a flow chart for setting documents in an automatic document feeding device.
Figure 7:
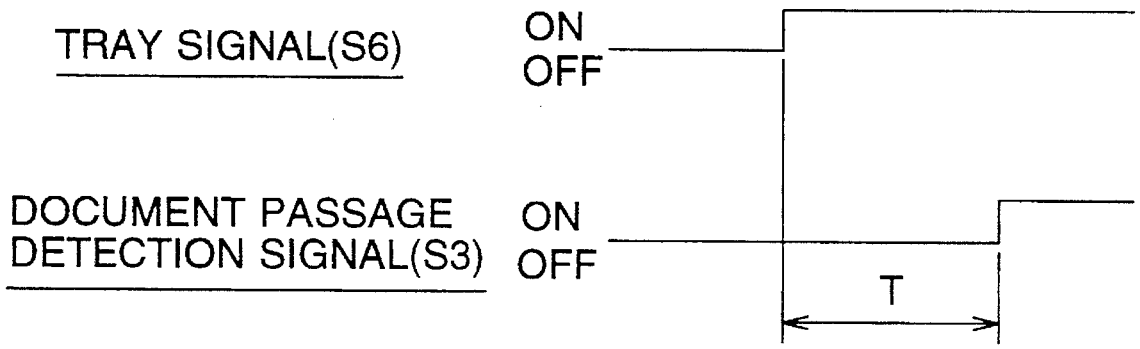
FIG. 7 is a time chart for signal generation in each of a tray sensor and a document passage sensor.

FIG. 6 is a flow chart for document setting in an automatic document feeding device and FIG. 7 is a time chart for signal generation of each of tray sensor S6 and document passage sensor S3.

A bundle of documents are stacked on document tray 11, and a leading edge of the document is inserted into an opening of an automatic document feeding device so that the document may pass through the upper portion of movable guide plate 21 in a falling state to hit the stopper member 22 to be set. Due to this, a light-accepting optical path for tray sensor (photosensor of a reflection type) S6 is formed, and OFF signal is generated accordingly to be sent copying machine main body 1. When actuator 27 of feeding section 22 is moved away by the leading edge of the document, an optical path for document setting detecting sensor S1 is intercepted, and 0N signal is generated accordingly to be sent to copying machine main body 1. Owing to sending of both signals mentioned above, the automatic document feeding device and the copying machine result in the state of ready for copying under an ADF mode.

When copy button 3 on copying machine main body 1 is turned on, conveyance of a document, conveyance of a recording sheet and an image forming process are started.

First, a preceding document is fed and a following document is fed preliminarily in feeding section 20 in automatic document feeding device main body 100. On the copying machine main body 1 side, on the other hand, a following recording sheet is fed preliminarily following a preceding recording sheet fed to an image forming section.

In the same manner as in the foregoing, document conveyance and recording sheet conveyance are repeated for the following sequence.

After the last document ($D_n$) is fed preliminarily during image reading for document ($D_{n-1}$) preceding the last document by one on platen glass 2, when the trailing edge of the last document ($D_n$) passes through an optical path for the tray sensor S6, the tray sensor S6 generates ON signals and sends them to copying machine main body 1 Since this tells that there is no succeeding document, it does not happen that the succeeding document is fed preliminarily by the signal of the tray sensor S6, though the recording sheet corresponding to the last document ($D_n$) has already been fed preliminarily.

Heretofore, the only way to confirm the last document ($D_n$) has been ON of document setting detecting sensor S1. Therefore, the recording sheet has been fed after waiting till the moment when the trailing edge of the document passes through the sensor S1. Thus, there has been no way but to reduce productivity of copying or to feed a recording sheet preliminarily once and then bring it back. However, it has become possible to detect earlier by time T shown in FIG. 7 by providing tray sensor S6 of the invention, which has become extremely advantageous for copying productivity and has solved the problem that a recording sheet needs to be fed preliminarily and be brought back. Incidentally, copying productivity is defined to be a value obtained by dividing the number of copies produced in a minute on a copying machine with the number of documents changed in a minute in an ADF, and it is most desirable that this value represents 100%.

As stated above, on a copying machine equipped with an automatic document feeding device of the invention, it is possible to conduct early the preliminary feeding of the last recording sheet corresponding to preliminary feeding of the last document among those stacked on a document tray, by providing a tray sensor on a document tray, and it is also possible to suspend preliminary feeding of a succeeding recording sheet and to prevent erroneous feeding, by making signals for no succeeding document early.

Further, when connecting a document tray provided with the aforementioned tray sensor to an automatic document feeding device main body, it is possible to connect signal lines of the tray sensor to those on the device main body quickly and securely through a single operation.

Figure 8:
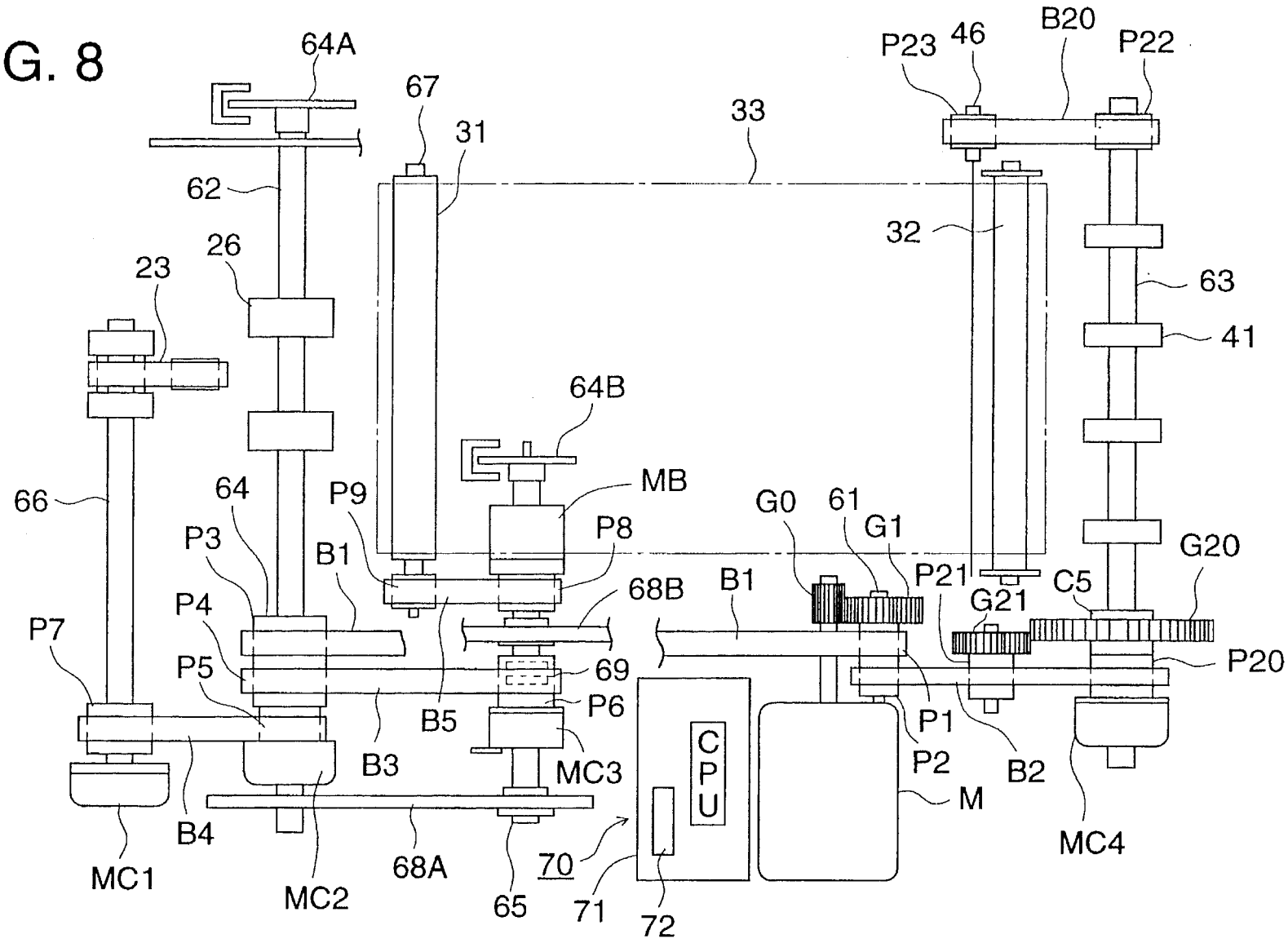
FIG. 8 is a general structural diagram showing a driving system for the above-mentioned automatic document feeding device.

Examples of an automatic document feeding device of the invention will be explained as follows, referring to the drawings attached hereto. First, a driving system for the automatic document feeding device will be explained referring to FIG. 8. FIG. 8 is a general structural diagram of the driving system (power transmission system) viewed from the side of a document pressure plane of conveyance belt 33.

At about the center of the automatic document feeding device main body, there is provided motor M that is a driving source. On the left side thereof, there is arranged a driving system for feeding section 20, at the center, there is arranged that for conveyance section 30, and on the right side, there is arranged that for ejecting section 40. The motor M which is a driving source rotates pulleys P1 and P2 located on intermediate shaft 61 through gear G0 and gear G1 that is located on the intermediate shaft 61. Belt B1 that is wound around the pulley P1 transmits power to intermediate conveyance roller shaft 62 having thereon pulley P3. On the other hand, belt B2 wound around pulley P2 on the intermediate shaft 61 transmits power to reversing roller shaft 63.

On the intermediate conveyance roller shaft 62 mentioned above, there are provided registering clutch MC2 that turns on and off driving power, intermediate conveyance pulley P3 and encoder 64A. Pulley P4 on the intermediate conveyance roller shaft 62 transmits driving power to conveyance clutch shaft 65 having thereon clutch pulley P6 through belt B3. Pulley P5 which is provided on the same shaft for the pulleys P3 and P4 transmits driving power to sheet-feeding driving shaft 66 having thereon pulley P7 through belt B4. On the sheet-feeding driving shaft 66, there is provided sheet-feeding MC1 which turns on and off power transmission.

On the conveyance clutch shaft 65, there are provided conveyance clutch MC3 that turns on and off rotation of the conveyance clutch shaft 65, electromagnetic brake MB, encoder 64B, and pulley P8. The pulley P8 transmits driving power to conveyance driving roller shaft 67 having thereon pulley P9 through belt 5. On conveyance driving shaft 67, there is formed conveyance driving roller 31 integrally. Around the conveyance driving roller 31 and conveyance driven roller 32, there is wound conveyance belt 33 so that it may rotate. Incidentally, 68A and 68B represent a frame affixed on the device main body. For each belt mentioned above, a toothed belt (a timing belt) was used, and for each pulley, a toothed pulley (a timing pulley) was used.

A power transmitting system branching from pulley P2 to the right hand side in the figure through belt B2 rotates reversing roller shaft 63 that is united with sheet-ejecting/reversing roller 41 integrally through pulleys P20 and P21 and gears G20 and G21. Pulley P22 provided on the other end of the reversing roller shaft 63 rotates pulley P23 and sheet-ejecting roller 46 that is in one piece with the pulley P23 through belt B20. Further, one-way clutch C5 is housed in gear G20, while electromagnetic clutch MC4 is housed in pulley P20. Due to this, when motor M runs inversely, sheet-ejecting roller 46 is rotated clockwise when viewed front ways through gear G21 that is in one piece with pulley P21, gear G20 and its built-in one-way clutch C5. When the motor M runs regularly, ON and OFF controlled by sheet-ejecting clutch MC4 make it possible either to rotate clockwise or to stop selectively form pulley P20. When the motor M runs regularly, gear G20 rotates in the direction opposite to the direction in which the gear G20 rotates under the inverse rotation of the motor M, no power is transmitted through one-way clutch C5.

Figure 9:
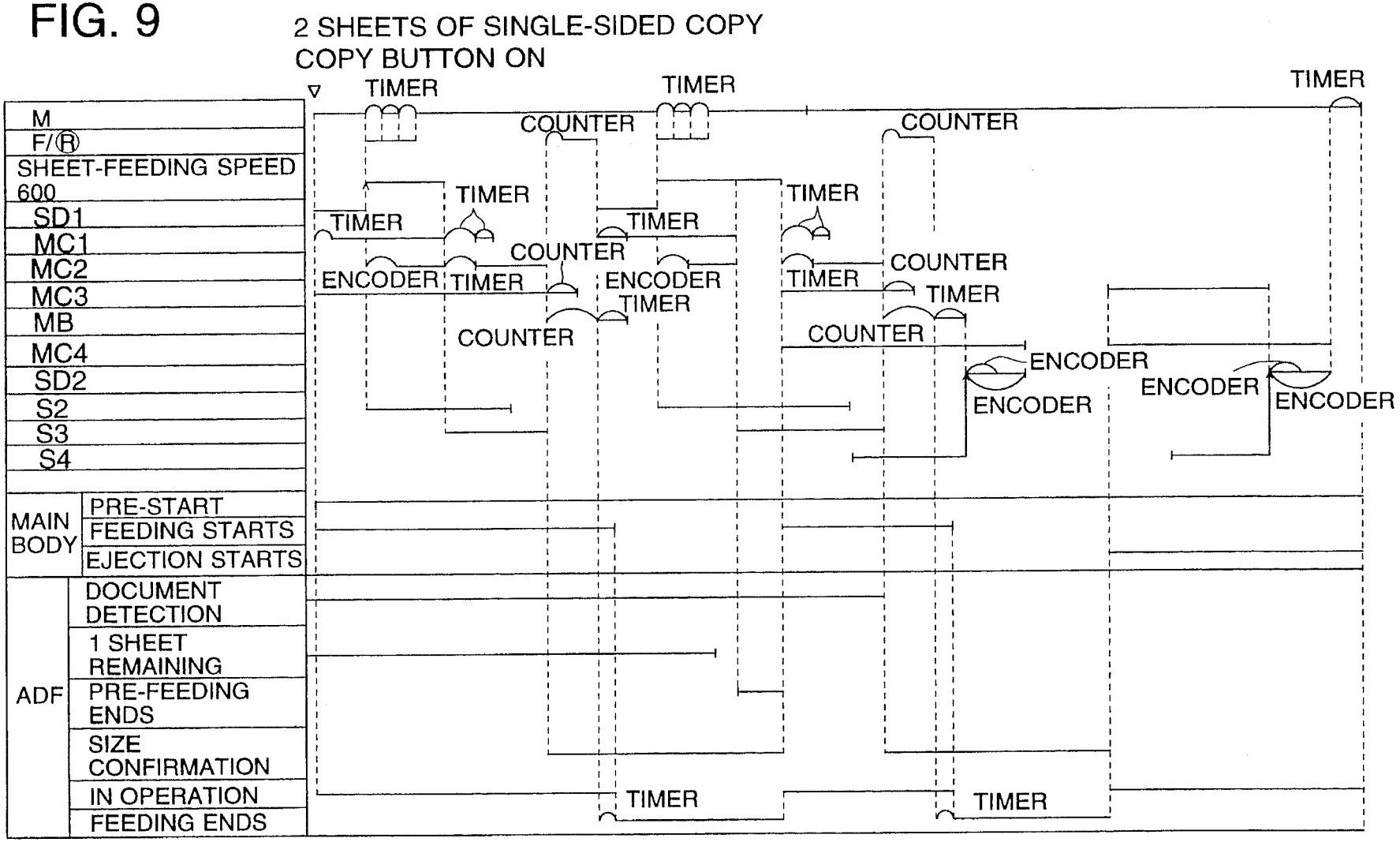
FIG. 9 is a time chart of an ADF mode for single-sided document copying.
Figure 10:
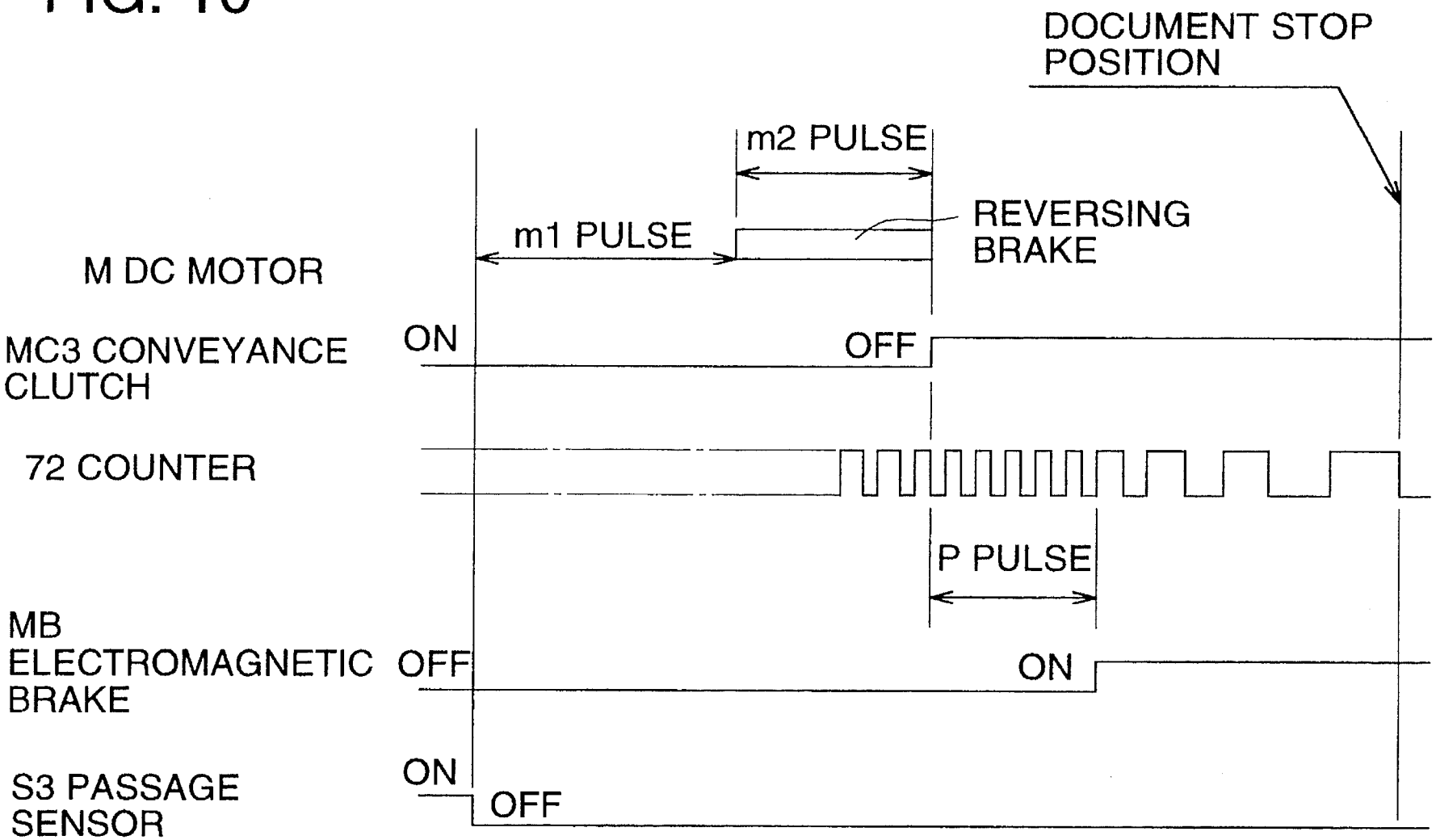
FIG. 10 is a time chart for control of a conveyance driving shaft in a conveyance section.
Figure 11:
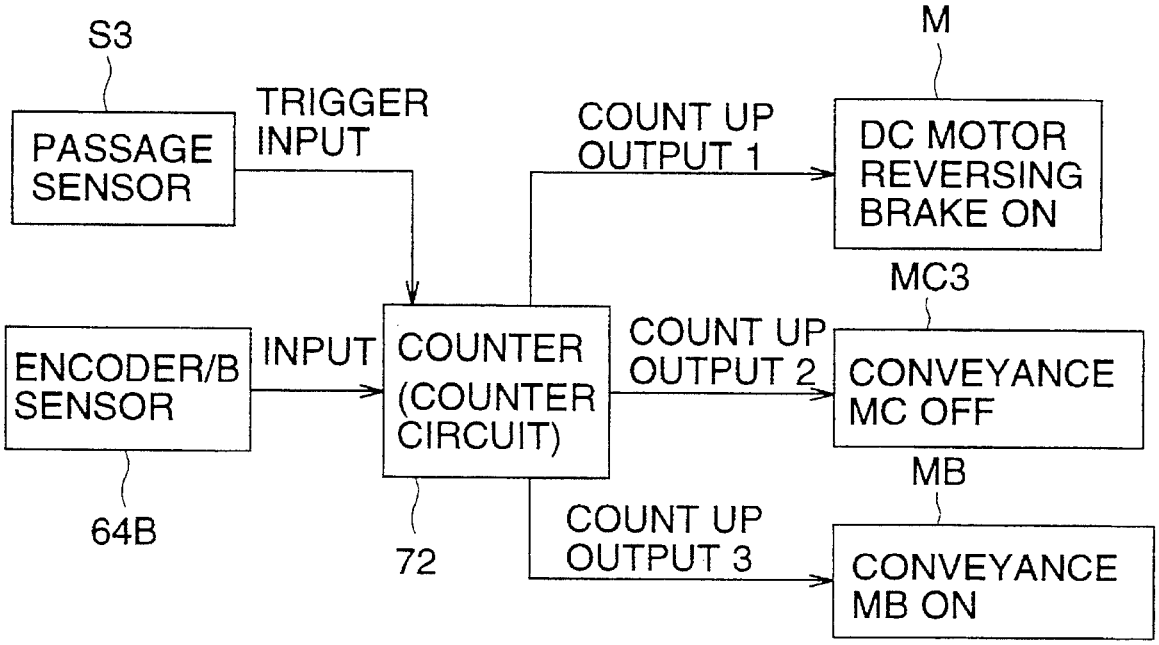
FIG. 11 is a block diagram of a hard counter in a conveyance section.

Next, control of a conveyance driving shaft for conveyance section 30 of an automatic document feeding device of the invention will be explained as follows, referring to FIGS. 9, 10 and 11. FIG. 9 is a time chart in a single-sided document copying mode (ADF mode), FIG. 10 is a time chart for control of a conveyance driving shaft, and FIG. 11 is a block diagram of a counter of a conveyance section.

A sheet of document fed out from a nip position on a separating means where separating belt 23 and reverse roller 25 are in pressure-contact with each other comes into contact with the surface of a roller in the vicinity of a nip position of a pair of registering rollers 26, where the document is caused to slip for a certain period of time while being urged in the conveyance direction to form a loop. Thus, the document can be prevented from skewing.

After that, when registering clutch MC2 provided on intermediate conveyance roller shaft 62 and conveyance clutch MC3 provided on conveyance clutch shaft 65 are engaged respectively, a pair of registering rollers 26 rotate and thereby document D is fed out again, and when the leading edge of the document passes through passage sensor S3, the registering clutch MC2 and sheet-feeding clutch MC1 are disengaged. When a predetermined number of counts (m1 pulse) is counted by encoder 64B after passage sensor S3 has detected passage of the trailing edge of the document and generated signals thereof, a brake by means of impressing inverse voltage is applied on D.C. motor M. After applying the brake by means of impressing inverse voltage on the D.C. motor for a certain period of time corresponding to a predetermined number of counts (m2 pulse), the conveyance clutch MC3 is immediately disengaged. After another predetermined number of counts (P pulse) from the moment mentioned above, electromagnetic brake MB provided on the conveyance clutch shaft 65 is engaged. Incidentally, the aforesaid P pulse is about several milliseconds or 10 milliseconds, and these count controls m1, m2 and P are controlled by counter 72 provided on base board 71 of control means 70, and each count number is established so that the trailing edge of a document may come to predetermined document reading position BL.

Figure 12:
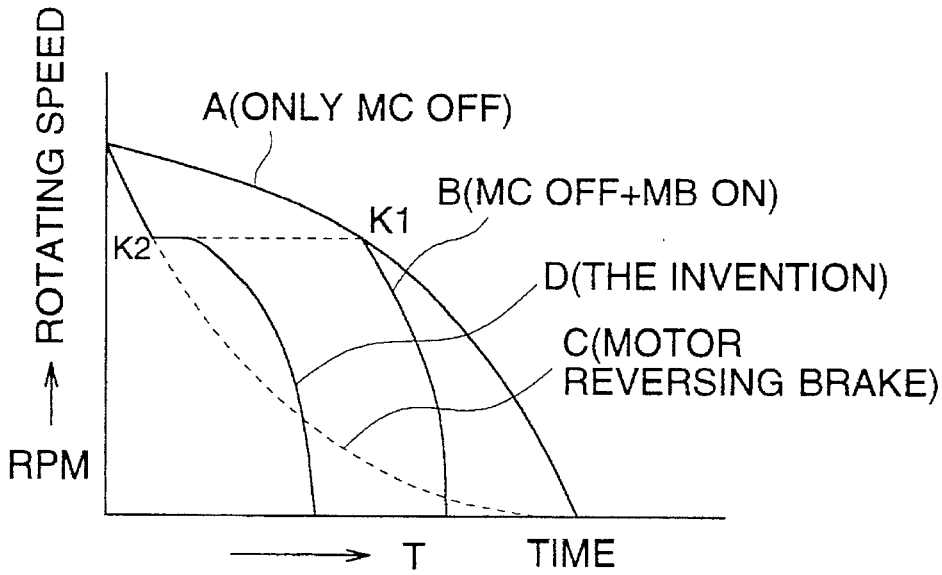
FIG. 12 is a characteristics diagram for control of document suspension.

FIG. 12 is a comparison speed characteristics diagram of various modes for controlling stop positions of documents.

In the figure, curve A represents speed characteristics for conventional document stopping by means of clutch disengagement only wherein a convex and gentle curve is shown on the upper portion thereof, and a long time is needed before a document stops and stop positions are scattered. Curve B represents speed characteristics for document stopping by means of both clutch disengagement and an electromagnetic brake wherein a document stops immediately after it passes through point K1, still requiring a long time before it stops. Curve C is a characteristics curve for only a brake that tries to rotate a motor inversely wherein a long time is still needed before a document stops. Curve D is a characteristics curve related to the invention wherein the curve falls sharply down to point K2 in the first stage due to a motor-reversing brake. After that, the motor runs idly with inertia and then stops suddenly due to operation of electromagnetic clutch MB. Owing to this, conveyance clutch shaft 65 can be stopped within a short period of time without being overstrained.

In the automatic document feeding device of the invention, a means for stopping and regulating a document of the invention is operated by establishing a predetermined pulse count number (m1, m2 and P pulse number) which is counted by a counter as stated above, and inertia of a power transmission system originated from a power source is cut when a D.C. motor reversing brake, a conveyance clutch and electromagnetic brake MB are operated in succession. Thus, it is possible to start document reading by stopping a document suddenly and thereby to shorten document changing time and to improve copy productivity. Further, it has become possible to position a document accurately.

Incidentally, there have been explained examples wherein a trailing edge of a document is stopped at a reference position. However, the invention can also be applied to a case wherein a leading edge of a document is stopped at a reference position.

Figure 13:
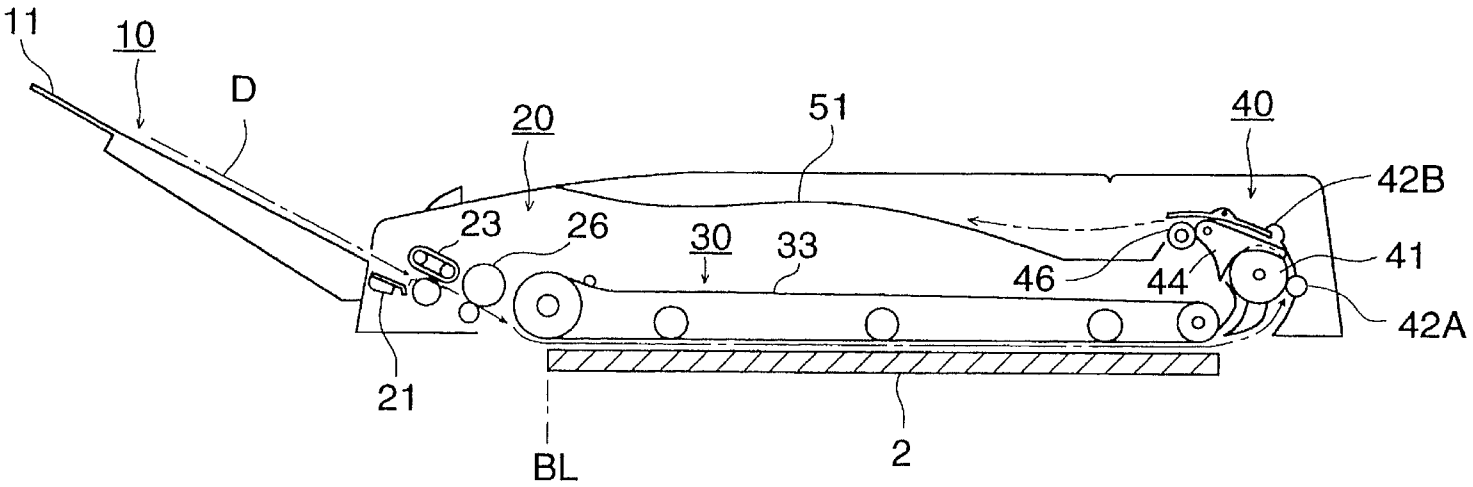
FIGS. 13 (A) and 13 (B) represent an illustrative diagram showing a path of document conveyance for each of an ADF mode and an R-ADF mode
Figure 13:
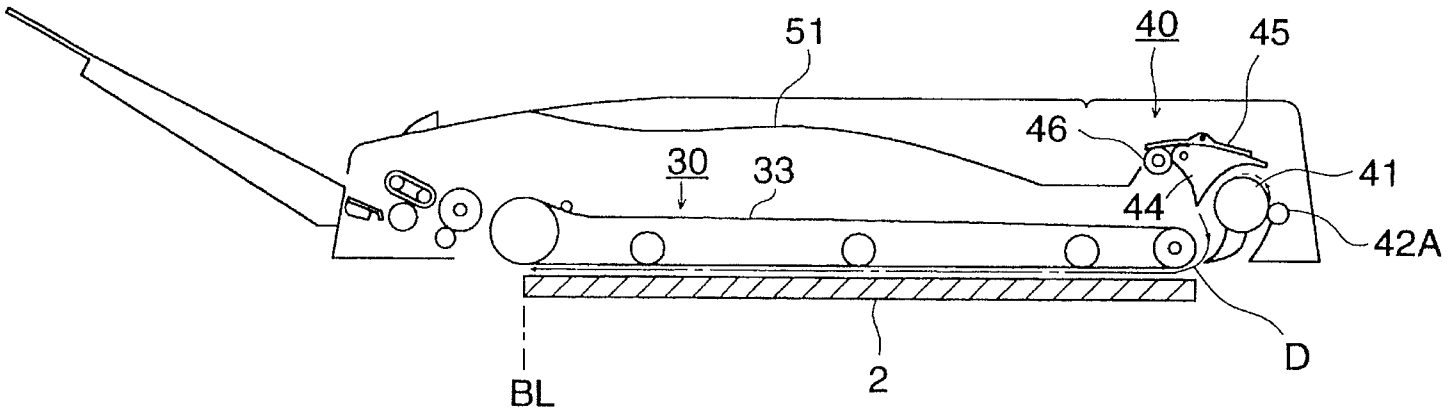

FIG. 13 (A) is an illustrative diagram showing a document conveyance path (dashed lines) in a single-sided document mode (ADF mode). Document D stacked on document tray 11 of document stacking section 10 is fed into one end on the surface of platen glass 2 through guide plate 21 of feeding section 20, separating belt 23 and a pair of intermediate conveyance rollers 26, then conveyed by conveyance belt 33 of conveyance section 30 until the trailing edge of the document arrives at reference position BL when the document is stopped momentarily to be subjected to exposure for image reading. The document which has been subjected to exposure is fed out of the other end on the platen glass 2 by conveyance belt 33, and then is conveyed to sheet-ejecting/reversing section 40. In the sheet-ejecting/reversing section 40, the document passes over sheet-ejecting/reversing switching means 44 while being nipped between sheet-ejecting/reversing roller 41 and pinch rollers 42A and 42B, and then is stacked onto ejected-sheet stacking surface 51 of delivery tray section 50 located outside an apparatus from ejected-sheet roller 46.

Figure 14:
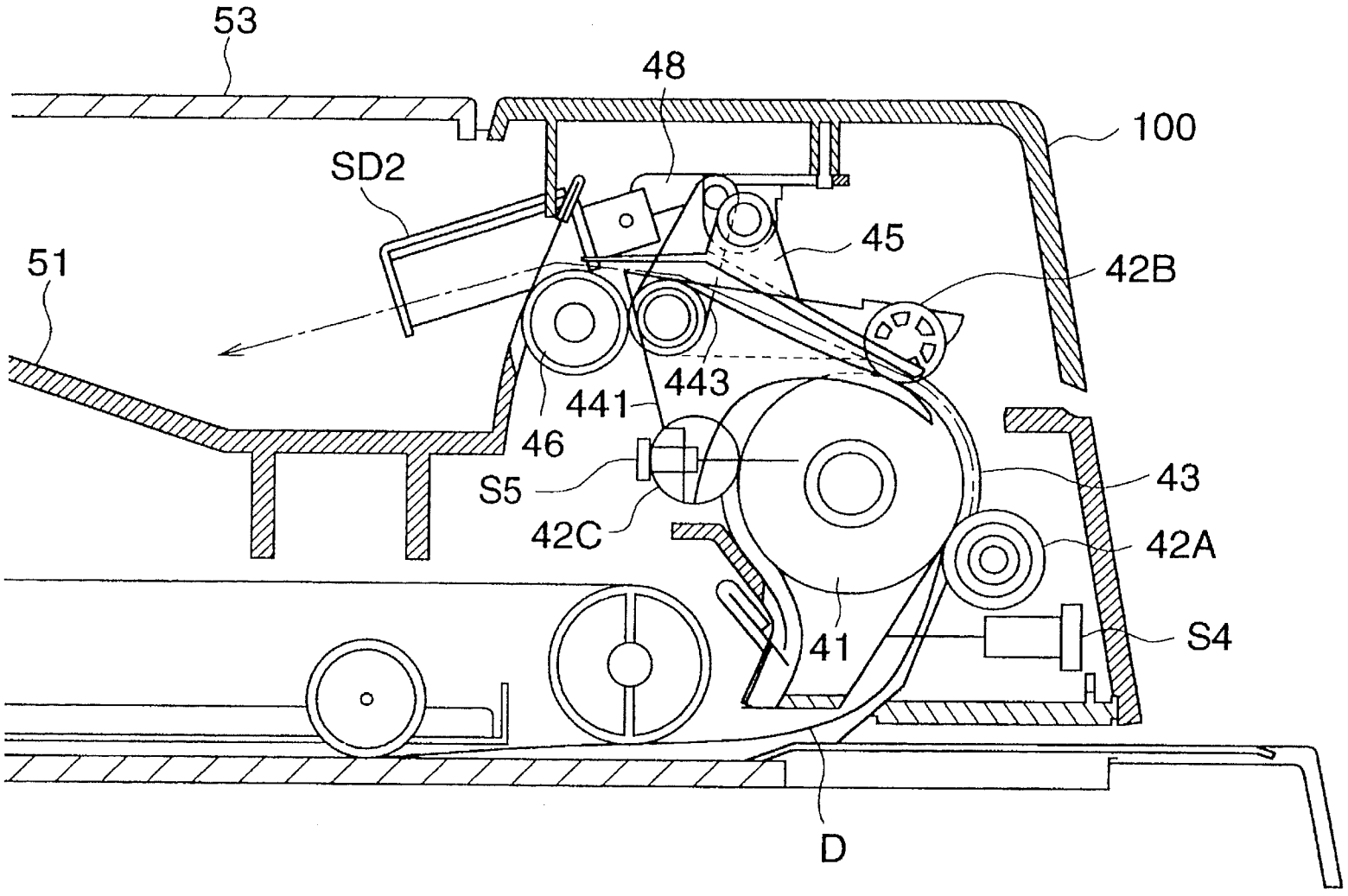
FIG. 14 is a sectional view of a sheet-ejecting/reversing section showing how a document is ejected at high speed.
Figure 15:
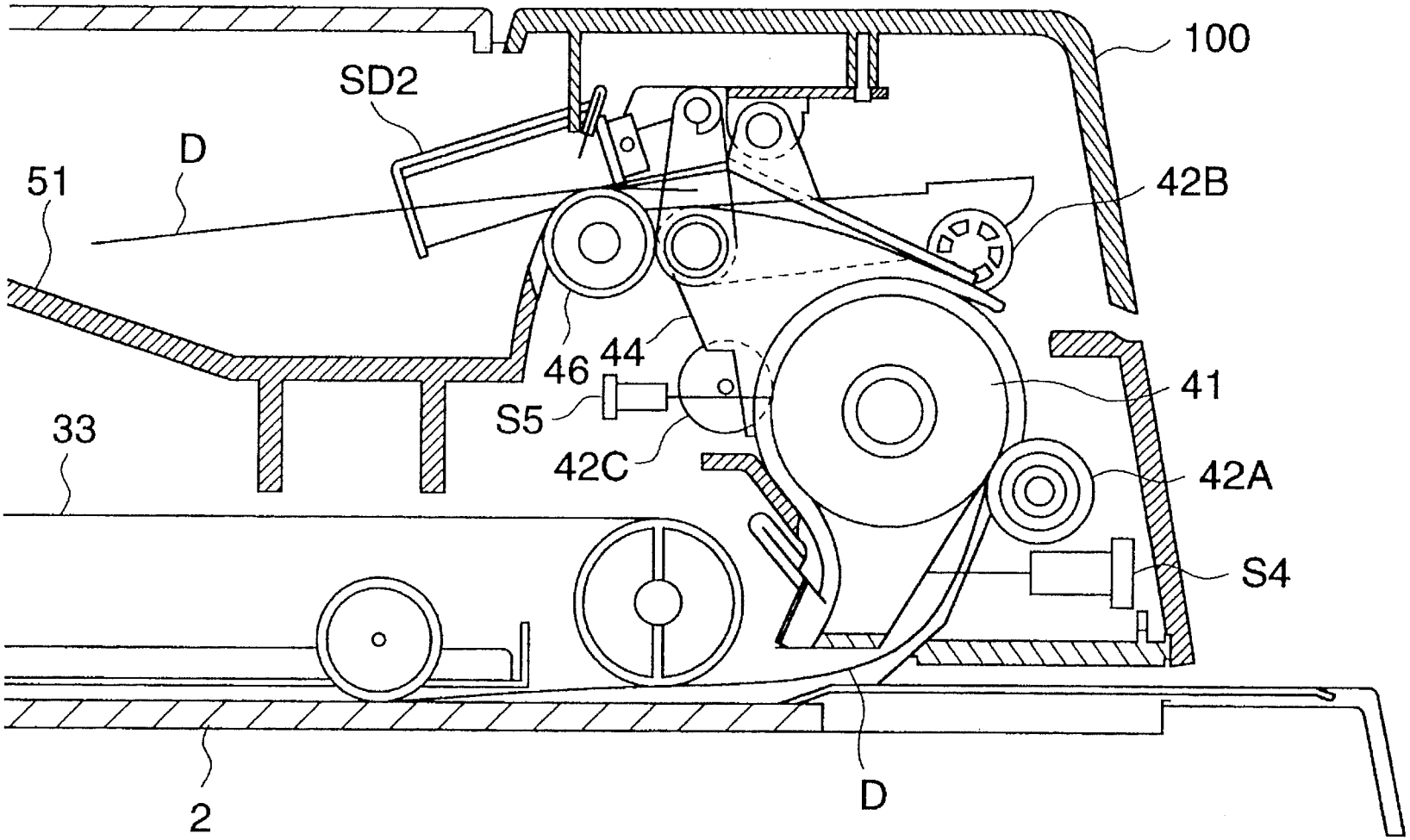
FIG. 15 is a sectional view of a sheet-ejecting/reversing section showing how a document is ejected at low speed.
Figure 16:
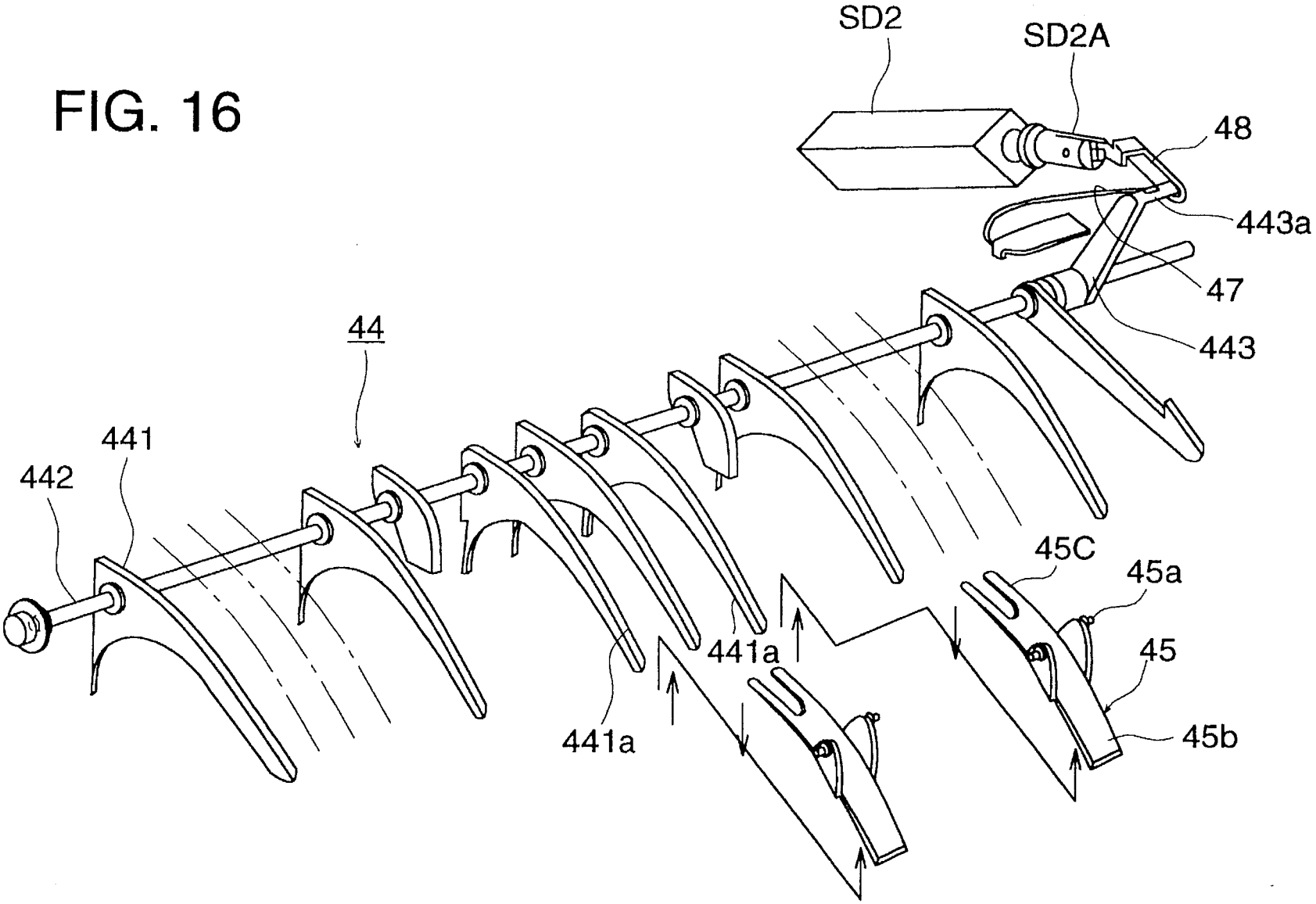
FIG. 16 is a perspective view of main portions of a sheet-ejecting/reversing switching means and a sheet-ejection regulating member.

FIG. 13 (B) is an illustrative diagram showing a document conveyance path (shown by dashed lines) in a double-sided document copy mode (R-ADF mode). Document D arrives at platen glass 2 through the aforementioned conveyance path is guided along the circumferential surface of sheet-ejecting/reversing roller 41 of sheet-ejecting/reversing section 40 to be conveyed through a path opened on the bottom surface side of switching claw 441, then fed again to the other side of the platen glass 2 and is conveyed reversely on the platen glass 2 by conveyance belt 33 that is moving reversely (in the arrowed direction in the figure). The leading edge of the document is detected by reverse-movement-sensor S5, and motor M is allowed to run for the fixed number of rotations after the detection of the leading edge of document, thus the document is stopped momentarily when its leading edge arrives at reference position BL, and the second side (back side) is subjected to exposure. After that, the document is guided to sheet-ejecting/reversing section 40 by the conveyance belt 33 that is moving regularly to be conveyed similarly to the foregoing, and when the trailing edge of the document (the trailing edge after entering) arrives at reference stopping position BL again, the document is stopped momentarily so that the first side (obverse side) may be subjected to exposure. The document whose both sides have been read is conveyed through conveyance section 30 and sheet-ejecting/reversing section 40 similarly to the aforesaid ADF mode and is stacked on ejected-sheet stacking surface 51 located outside an apparatus. FIG. 14 is a sectional view of sheet-ejecting/reversing section 40 and its neighborhood showing how a document is ejected at high speed, FIG. 15 is a sectional view of sheet-ejecting/reversing section 40 showing how a document is ejected at low speed or how it is reversed, and FIG. 16 is a perspective view of main portions of a sheet-ejecting/reversing switching means and a sheet ejection regulating member both of the sheet-ejecting/reversing section 40.

In sheet-ejecting/reversing section 40, a document conveyance path is formed by sheet-ejecting/reversing roller 41, pinch rollers 42A, 42B and 42C, guide plate 43, sheet-ejecting/reversing switching means 44, sheet-ejection regulating member (movable pressure plate) 45 and sheet-ejecting roller 46. In the vicinity of the upstream side of pinch roller S4 which detects a pass of the leading edge of a document and that of the trailing edge thereof.

After generation of signals made by the aforesaid ejected-sheet sensor S4 for detection of passage of the leading edge of a document, electromagnetic clutch MC4 is engaged after a predetermined period of time controlled by a timer, and power from motor M is transmitted to a driving shaft of sheet-ejecting/reversing roller 41, thus the rotation is started. Thereby, the leading edge of document D hits the nip portion between sheet-ejecting/reversing roller 41 and pinch roller 42A to form a loop so that a skewed document may be corrected, and then conveyed, moved upward along guide plate 43, passed through a position pinched by pinch roller 42B, and then conveyed toward sheet-ejecting roller 46.

Incidentally, it is also acceptable that an accuracy for a conveyance position is improved through a method wherein a document conveyance speed is lowered only when the leading edge of a document fed out of conveyance section 30 hits a point located in the vicinity of a nip portion between sheet-ejecting/reversing roller 41 and pinch roller 42A, and thereby the leading edge of a document is registered through position correction made by edge hitting.

The sheet-ejecting/reversing switching means 44 mentioned above is integrally composed of shaft 442 whose both ends are rotatably supported on automatic document feeding device main body 100, plural switching claws 441 affixed on the shaft 442 and swing lever 443.

Acting portion 443*a* located at the tip of the swing lever 443 is urged by pressure spring 47 in one direction. The acting portion 443*a* is further connected to and engaged with a recess of operating plate 48 that is supported rotatably on plunger SD2A of sheet-ejecting solenoid SD2 that is for ejecting and reversing.

Shaft portion 45*a* located near the center of the sheet ejection regulating member 45 is engaged with automatic document feeding device main body 100 and is supported rotatably. A bottom surface of the sheet ejection regulating member 45 is curved and forms a part of a document conveyance guide surface. Guide surface 45*b* located at the upstream side in terms of document conveyance on the sheet ejection regulating member 45 is greater in terms of weight than guide surface 45*c* located at the downstream side on the other side. Due to a difference of weight between them, therefore, the sheet ejection regulating member 45 is stopped by a stopper with its guide surface 45*b* taking the lower position. Incidentally, the sheet ejection regulating member 45 may also be urged by a spring so that its one side may take the lower position.

A bottom surface at the tip of the guide surface 45*b* located at the upstream side on the above-mentioned sheet ejection regulating member 45 is arranged to be capable of coming in contact with or leaving upper surface section 441*a* located at the vicinity of a tip of the aforesaid switching claw 441. On the other hand, a bottom surface at the tip of the guide surface 45*c* located at the downstream side is arranged to be capable of coming in contact with or leaving the aforesaid sheet-ejecting roller 46.

A leading edge of the document that has passed a nip portion between the sheet-ejecting/reversing roller 41 and the pinch roller 42B both mentioned above passes through a conveyance path formed between switching claw 441 of sheet-ejecting/reversing switching means 44 shown in FIG. 14 and sheet ejection regulating member 45, and then passes through the upper part of sheet-ejecting roller 46 to be ejected out of an apparatus. Incidentally, when a document is ejected out, left end 45C of the sheet ejection regulating member 45 is located at its highest position to be in non-contact with the sheet-ejecting roller 46 to form an outlet for ejection.

When there is time-controlled a predetermined time period during which the trailing edge of document D passes through a detection position of the ejected-sheet sensor S4, then passes through the pinch roller 42B, and further advances to arrive at a point located to be at the upstream side by about 15 mm of the sheet-ejecting roller 46, and when the predetermined time period is up, sheet-ejecting solenoid SD2 is energized to start operating. Namely, when the sheet-ejecting solenoid SD2 is turned on, plunger SD2A is pulled to attract operating plate 48, and thereby swing lever 443 is rotated counterclockwise against urging force of pressure spring 47. Thereby, shaft 442 and switching claw 441 are also rotated counterclockwise integrally, and upper surface section 441*a* at the tip of switching claw 441 goes up to close an ejection path, then further goes up to push up guide surface 45*b* located at the upstream side of sheet ejection regulating member 45 to swing it counterclockwise around shaft portion 45*a*. At the terminal position of the swing, a tip portion of guide surface 45*c* located at the downstream side of the sheet ejection regulating member 45 comes in slight-contact with sheet-ejecting roller 46.

After the trailing edge of the document D that is being ejected passes through a nip position of pinch roller 42B and passes through a predetermined position located to be at the upstream side by about 15 mm from the position of pressure-contact with sheet-ejecting roller 46, when the aforesaid sheet-ejecting roller 46 rotating at low speed (for example, 240 mm/sec) comes in pressure-contact with sheet ejection regulating member 45, the trailing edge of the document D pressure-sandwiched between them is ejected at low speed. After the document has been ejected, when solenoid SD2 is turned off, urging force of pressure spring 47 causes the tip portion located at the upstream side of switching claw 441 and that of sheet ejection regulating member 45 to fall to return to the original position.

In an R-ADF mode for conveying double-sided documents, when the trailing edge of a document passes through document detecting sensor (passage detecting sensor) S3 in conveyance section 20, signals of the detection turn sheet ejecting solenoid SD2 on and cause switching claw 441 to rise to form a conveyance path for reversing, simultaneously with sheet ejection at low speed in the above-mentioned ADF mode. Document D conveyed from conveyance section 30 is fed into ejected-sheet reversing section 40 where the leading edge of the document hits a nip portion between sheet-ejecting/reversing roller 41 and pinch roller 42A to form a buckle (loop), so that the leading edge of the document is aligned (registered) and its skew is corrected. When a predetermined period of time measured by a timer has elapsed after the detection of the leading edge of the document conducted by ejected-sheet sensor S4, electromagnetic clutch MC4 is engaged to rotate sheet-ejecting/reversing roller 41.

Document D is nipped between rotating sheet-ejecting/reversing roller 41 and pinch rollers 42A and 42B both driven by the sheet-ejecting/reversing roller to be conveyed, and it branches due to the switching claw 441 and advances through a reversing path along the bottom curved surface of the switching claw. The document is reversed by a nip between sheet-ejecting/reversing roller 41 and pinch roller 42C to be conveyed to an edge of platen glass 2 where conveyance belt 33 moving reversely conveys the document to reference stop position BL for exposure on the platen glass 2 (see FIG. 15).

Namely, when a pass of the trailing edge of a document is detected by reversing sensor 55, sheet ejecting solenoid SD2 is turned off to switch to sheet ejection of an ordinary ADF mode. When a predetermined period of time measured by a timer has elapsed after generation of detection signals for the leading edge of a document made by the reversing sensor S5 mentioned above, a brake for impression of voltage for reversing a motor is operated, then electromagnetic clutch MC3 is disengaged, and electromagnetic brake MB is further turned on after a predetermined short period of time to stop the conveyance belt 33 suddenly. Due to operations of the electromagnetic clutch MC3 and electromagnetic brake MB both controlled by a timer, the double-sided document conveyed reversely onto the platen glass 2 is stopped accurately at predetermined reference position for reading BL.

Figure 17:
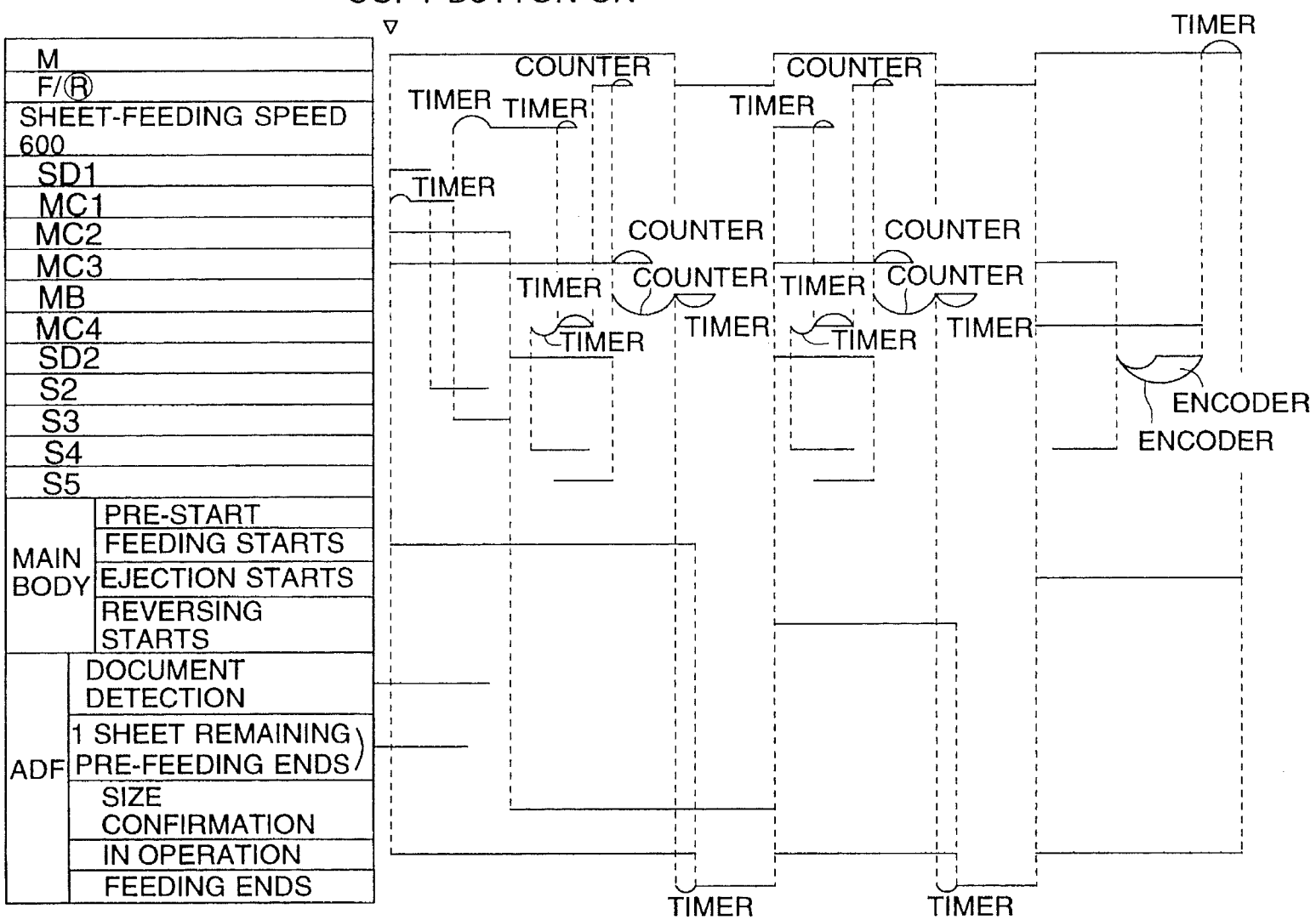
FIG. 17 is a time chart of an R-ADF mode for double-sided document copying.

FIG. 17 is a time chart of an R-ADF mode for conveying double-sided documents. Incidentally, when a double-sided document is conveyed by the automatic document feeding device, the document is conveyed from feeding section 20 to conveyance section 30 and to sheet-ejecting/reversing section 40 where the document is turned over. Then, the document is fed to the conveyance section again and is stopped at the reference position so that the second side of the document may be subjected to exposure. After that, the document is fed again to sheet-ejecting/reversing section 40 where it is turned over, and then is conveyed to conveyance section 30 where the first side of the document is subjected to exposure. After that, the document is conveyed to the sheet-ejecting/reversing section 40 so that it is turned over to be stacked on ejected-sheet stacking surface 51 of delivery tray section 50 with its first side facing upward.

A document ejected from sheet-ejecting roller 46 is ejected at high speed first as stated above (for example, 1200 mm/sec), but before the trailing edge of the document approaches the sheet-ejecting roller 46, the document comes in pressure-contact with ejected-sheet regulating member 45 and thereby is ejected at low speed (for example, 240 mm/sec) to be stacked on ejected-sheet stacking surface 51 located outside an apparatus. The ejected-sheet stacking surface 51 is formed with an inclined curved plane that rises slightly toward the downstream side in terms of sheet ejection and with a plane that is almost horizontal. When document D to be ejected is small in size, it rises along the inclined curved plane and the trailing edge of the document leaves the position of pressure-contact with the sheet ejecting roller 46, thus the document is stopped and stacked on the ejected-sheet stacking surface 51.

When a document of the maximum size such as an A3 size document or an 11×17 inch size document, for example, is ejected, a leading edge of the document of the maximum size passes through the aforesaid rising curved plane and the small horizontal plane to be stacked thereon. Therefore, the document jumps and its ejected position varies. Incidentally, the ejected-sheet stacking surface 51 for documents is formed at a part of an external top face of automatic document feeding device main body 100, and it is composed of an inclined curved plane and a horizontal plane so that the device main body 100 can be small in size with its total height limited.

At a position where a leading edge portion of the maximum size document mentioned above among those ejected on the ejected-sheet stacking surface 51 hits on the downstream side in terms of document ejection on the aforesaid ejected-sheet stacking surface 51, there is provided a document stopping means capable of stopping a document. The document stopping means is stopper portion 52 in shape of a protrusion formed integrally with automatic document feeding device main body 100, and it is positioned approximately at the center of document width (see FIG. 2).

The numeral 53 is a document cover provided over ejected-sheet stacking surface 51, and it prevents that documents stacked on ejected-sheet stacking surface 51 fall or scatter when automatic document feeding device main body 100 is lifted and the surface on platen glass 2 located on the top of copying machine main body 1 is opened or the document fall or scatter being affected by the flow of external air. Further, a part of the document cover 53 positioned at stopper section 52 side is cut off to form cutout 53*a* so that a document of the maximum size may be taken out easily.

As stated above, an automatic document feeding device of the invention offers following effects. (1) Positional accuracy for document conveyance is improved and accuracy of an image forming position for double-sided document copying is improved both by registering a leading edge of a document in a sheet-ejecting/reversing section. (2) When a document is ejected from a sheet-ejecting/reversing section to a delivery tray section located outside of an apparatus, there is neither occurrence of scattering of ejected documents nor occurrence of troubles of sheet ejection because a trailing edge of the document is ejected at low speed. Further, it is not necessary to incline sharply a delivery tray of a conventional copying machine, thereby it is possible to make an apparatus small in size by limiting the total height thereof, and ambient space needed for opening an ADF can be small because an upper space is smallest. In particular, both a document-ejecting/reversing switching claw and a conveyance regulating member for low speed sheet ejection can be controlled by one sheet-ejecting solenoid. Therefore, a construction can be simple to achieve a small size, light weight, stable operations and inexpensive price, which are advantageous points. (3) Due to a document stopping section (stopper section) provided on one end of a delivery tray section for preventing a document of the maximum size from jumping off, documents do not scatter, and it is easy to take out used documents and to align documents.

What is claimed is:

1. A copying apparatus provided with an automatic document feeding apparatus, comprising:

(a) a document stacker on which a plurality of documents are positioned and stacked;

(b) a document feeding section for separating a sheet of document from the plurality of documents stacked on said document stacker and then for feeding;

(c) an image reading section for reading an image of the document fed by said document feeding section;

(d) a conveyance section for conveying the document fed by said document feeding section and for stopping at a predetermined position at which image reading operation is conducted by said image reading section, and then for conveying;

(e) a sheet ejecting section disposed at a downstream side in a conveying direction from said image reading section, for ejecting the document conveyed by said conveyance section;

(f) an exit tray section for receiving the document ejected by said ejecting section;

(g) a detector provided on said document stacker, for detecting passage of a trailing edge of a last document stacked on said document stacker and for sending a detected signal to a main body of said copying apparatus; and (h) control means for controlling feeding of recording sheets stored in a sheet feeding section provided in said main body, according to the detected signal.

2. The copying apparatus of claim 1, wherein said detector sends the detected signal when preliminary feeding of a recording sheet by said sheet feeding section corresponding to a last document is conducted.

3. The copying apparatus of claim 1, wherein said detector is disposed at a position where detection of a trailing edge of a minimum size sheet on said document stacker can be performed.

4. The copying apparatus of claim 1, wherein said control means controls feeding of recording sheets so that a succeeding recording sheet next to a recording sheet corresponding to the last document stacked on said document stacker is stopped.

* * * * *